United States Patent [19]

Strombeck

[11] Patent Number: 4,471,601

[45] Date of Patent: Sep. 18, 1984

[54] MACHINE FOR ERECTING, FILLING AND CLOSING CARTONS

[75] Inventor: Leo Strombeck, Rockford, Ill.

[73] Assignee: Anderson Bros. Mfg. Co., Rockford, Ill.

[21] Appl. No.: 319,095

[22] Filed: Nov. 6, 1981

[51] Int. Cl.[3] ..... B65B 3/00; B65B 7/20; B65B 43/28

[52] U.S. Cl. ..... 53/564; 53/266 R; 53/374; 53/381 R; 53/383; 141/172; 493/177; 493/183; 493/316; 493/453

[58] Field of Search ..... 53/207, 209, 218, 266 R, 53/284, 374, 381 R, 383, 382, 564, 566; 493/124, 125, 131, 183, 177, 316, 453, 456; 198/772; 141/154, 350, 172

[56] References Cited

U.S. PATENT DOCUMENTS

| | | | |
|---|---|---|---|
| Re. 27,631 | 5/1973 | Berney | 493/131 |
| 732,703 | 7/1903 | Brown | 53/374 X |
| 1,025,173 | 5/1912 | Wegner | 198/772 X |
| 1,489,134 | 4/1924 | Ladd | 53/564 |
| 2,004,816 | 6/1935 | Lindgren | 198/772 X |
| 2,268,423 | 12/1941 | Rose | 53/374 X |
| 2,612,016 | 9/1952 | Anderson . | |
| 2,756,553 | 7/1956 | Ferguson | 53/374 |
| 3,146,566 | 9/1964 | Roth | 53/374 |
| 3,206,915 | 9/1965 | Anderson et al. . | |
| 3,350,841 | 11/1967 | McDonald | 53/374 X |
| 3,364,651 | 1/1968 | Stohlquist . | |
| 3,389,645 | 6/1968 | Winters | 493/183 X |
| 3,418,893 | 12/1968 | Stohlquist | 493/313 |
| 3,442,062 | 5/1969 | Lense | 53/374 |
| 3,442,063 | 5/1969 | Martin | 53/374 |
| 3,466,838 | 9/1969 | Sorenson et al. . | |
| 4,018,143 | 4/1977 | Dice | 493/131 |
| 4,239,115 | 12/1980 | Froom . | |

*Primary Examiner*—John Sipos
*Attorney, Agent, or Firm*—Vernon J. Pillote

[57] ABSTRACT

An intermittently cycled packaging machine for erecting, filling, closing and sealing cartons with hot meal adhesive. A reciprocation carton transfer mechanism is cycled in response to filling of a carton at the filling station and is operative to advance cartons in step fashion from a carton erecting station past a lower carton closing station, the filling station and an upper carton closing station with the last flap to be folded at the lead side of the carton, and the adhesive applying nozzles and the lead flap folding apparatus are located in relation to each other and to the stroke of the transfer mechanism such that adhesive is applied to the end flaps on the carton and the lead flap is infolded as the carton is advanced in a continuous forward step. Lead flap guides are provided for deflecting the lead end flap forwardly of the lead panel during erecting of the carton. A carton stabilizer is provided for preventing retrograde movement of the carton at the filling station during retraction of the transfer mechanism. A flap depressor is provided for depressing the lead flap in advance of the filling station.

20 Claims, 26 Drawing Figures

MACHINE FOR ERECTING, FILLING AND CLOSING CARTONS

BACKGROUND OF THE INVENTION

Packaging machines have heretofore been made for example as shown in U.S. Pat. Nos. 2,612,016; 3,206,915; 3,364,651 and 3,466,838 for packaging material in rectangular cartons which are initially supplied in a flattened condition and have four body panels interconnected along fold lines to form a rectangular body and closure flaps interconnected along fold lines to the four body panels for closing ends of the carton. In general, the packaging machines disclosed in the aforementioned patents are arranged to open and erect carton blanks at a carton infeed station and have a transfer mechanism mounted for extension and retraction along a path and operative when driven through a transfer cycle to advance a series of cartons in step fashion from the infeed station sequentially past a lower carton closing station; a filling station; and an upper carton closing station. In these packaging machines, product is dispensed in continuous fashion through a downwardly opening nozzle at the filling station and an elevator at the filling station is operated in timed relation with the transfer mechanism to elevate a carton into partial telescoping relation with the nozzle and then allow the carton to move down as it is filled. When the carton at the filling station reaches a preselected lower position, a transfer cycle is initiated to advance the series of cartons along the path in a forward step. Such packaging machines are herein referred to as intermittently cycled packaging machines.

Some prior intermittently cycled packaging machines such as disclosed in U.S. Pat. Nos. 2,612,016 and 3,364,651 are adapted to handle cartons having mechanically interlocking end flaps on the narrow side panels of the cartons and such machines were arranged to first infold the end flaps on the wide panels of the carton and then infold and interlock the end flaps on the narrow side panels. U.S. Pat. No. 3,206,915 also discloses an intermittently cycled packaging machine adapted for handling cartons having mechanical interlocking end flaps, and this patent further discloses an adhesive applying attachment at the outlet end of the packaging machine to adapt the machine to handle chest-type cartons that have, in addition to the mechanical interlocking end flaps, a tab at each end of the cover flange which is adapted to be secured to an end flap on an adjacent side panel of the carton. The adhesive applying attachment in U.S. Pat. No. 3,206,915 was arranged to move the filled and closed cartons crosswise of the outlet end of the packaging machine; apply a spot of glue to the top and bottoms of the cartons while the cartons were at rest; and then advance the cartons past upper and lower plows that folded the end tabs onto the glue spots. Some other intermittently cycled packaging machines such as shown in U.S. Pat. No. 3,466,838 are arranged to erect, fill, close, and heat seal cartons having pre-glued end flaps, with the heat sealers arranged to heat the pre-glued end flaps after both ends of the carton were closed and while the cartons were at rest during a dwell period between transfer cycles.

U.S. Pat. No. 4,239,115 discloses a carton construction adapted to have the end flaps closed and sealed with hot melt adhesive when the end flaps are folded in a particular sequence and the adhesive is applied in a particular adhesive pattern. More specifically, the carton in this patent has the end flap on one wide side panel dimensioned so that, when infolded last, it overlaps portions of the other three end flaps, and closing of the carton is effected by sequentially infolding the end flaps on the two narrow side panels; infolding the end flap on the other wide side panel; applying hot melt adhesive on the infolded end flaps in bands paralleling the narrow side panels, and then infolding the end flap on the first mentioned wide side panel.

The adaptation of intermittently cycled packaging machines of the type described above to the closing and sealing of such cartons with hot melt adhesive has presented special problems. Such packaging machines have a dwell period between each transfer cycle to allow time for dispensing the required quantity of product from the nozzle into the carton at the fill station. The dwell period of the machine will vary dependent on the rate to which the product is dispensed from the nozzle into the cartons, and the glue application and flap folding must be so arranged that reliable sealing is effected independent of variations in the packaging machine fill time. Further, since the product is dispensed continuously from the nozzle on the packaging machine, it is important to advance the carton past the nozzle with the wide side panels of the carton transverse to the path of movement of the carton, in order to minimize the amount of material that flows from the nozzle during movement of the filled carton away from the nozzle and the next empty carton into position below the nozzle. The glue application and flap folding must therefore also be arranged so that it will apply adhesive in the proper pattern on the infolded end flaps on the carton and rapidly fold the final end flap onto the adhesive, when the carton is oriented with the wide side panels extending crosswise of the path of advance of the cartons in the packaging machine. Further, the lower flap folding and adhesive applying mechanism must be capable of closing the lower ends of the cartons when they are empty while the upper flap folding and adhesive applying mechanism must be capable of closing the cartons when they are filled. The latter presents particular problems when packaging semi-frozen products such as ice cream and the like, since the cold product accelerates the set-up of the hot melt adhesive.

OBJECTS OF THE INVENTION

An important object of this invention is to provide an intermittently cycled packaging machine which is arranged to close and seal the end flaps on the cartons utilizing a hot melt adhesive.

Another object of this invention is to provide an intermittently cycled packaging machine in accordance with the foregoing object, and in which the application of adhesive to the end flaps on the cartons and the folding of the last flap on the end of the carton is effected while the transfer mechanism is advancing the carton in a single continuous forward step, to rapidly infold the last end flap onto the hot melt adhesive before the latter can start to set.

Another object of this invention is to provide an intermittently cycled packaging machine in accordance with the foregoing object which is arranged to advance the cartons through the machine with the last end flap to be folded at the lead side of the carton and which has an improved arrangement for infolding the last end flap on the carton onto the adhesive applied to the other infolded end flaps, in response to advance of the carton by the carton transfer mechanism.

Another object of this invention is to provide an intermittently cycled packaging machine having an improved apparatus at the carton infeed station for deflecting the flaps on the ends of the carton during opening and erecting of the carton during opening and erecting of the carton blanks.

Another object of this invention is to provide an intermittently cycled packaging machine having an improved arrangement for inhibiting retrograde movement of the carton at the filling station.

Still another object of this invention is to provide an intermittently cycled packaging machine having an improved arrangement for depressing the lead flap on the carton before it reaches the filling station to avoid interference with the trailing flap on the carton being elevated at the filling station and to prevent the lead flap from contacting the material emerging from the dispensing nozzle as the carton is advanced to a position below the nozzle.

These, together with objects of this invention will be more readily appreciated as the invention becomes better understood by reference to the following detailed description, when taken in connection with the accompanying drawings wherein.

Figure 1:
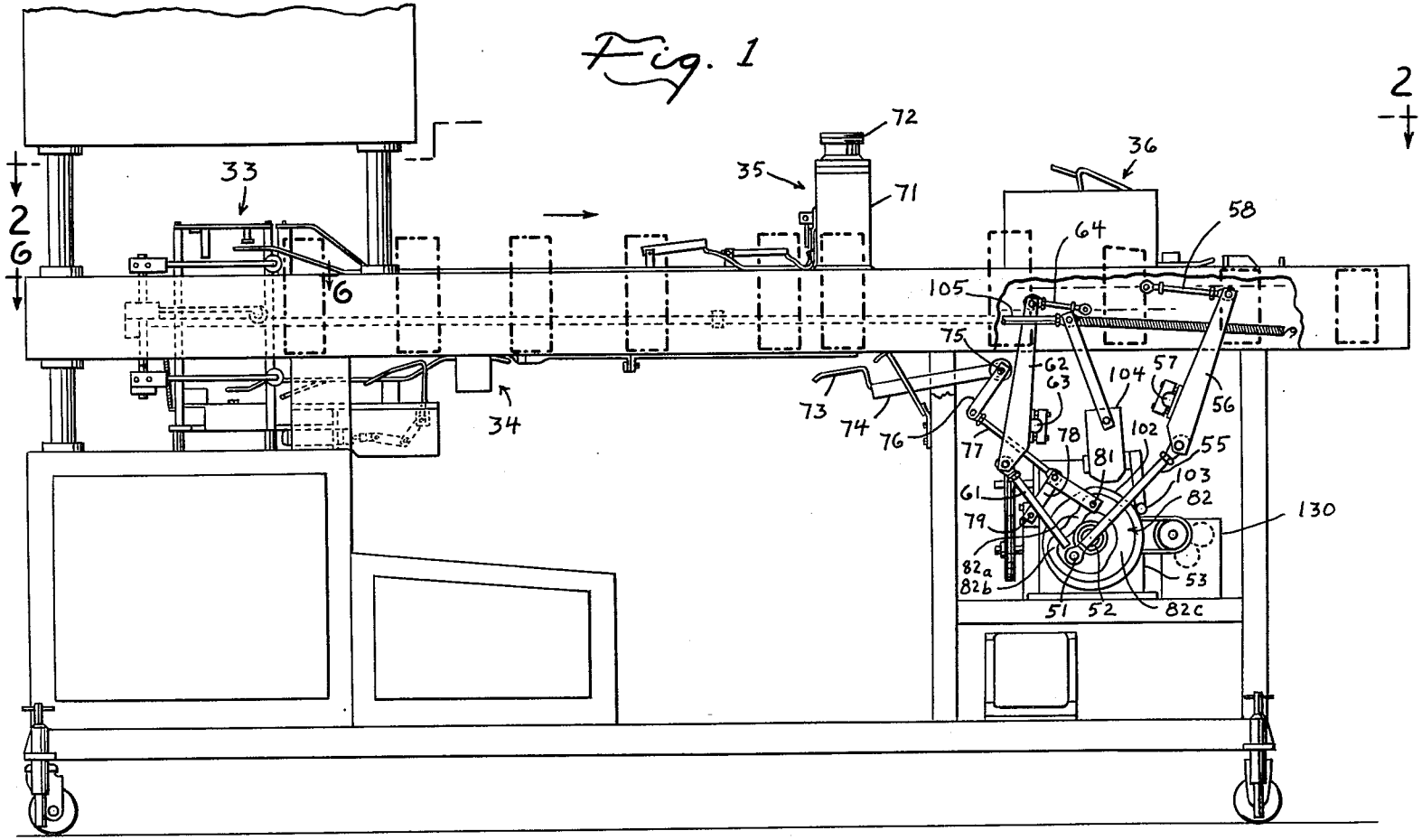
FIG. 1 is a side elevational view of a packaging machine embodying the present inventions.
Figure 2:
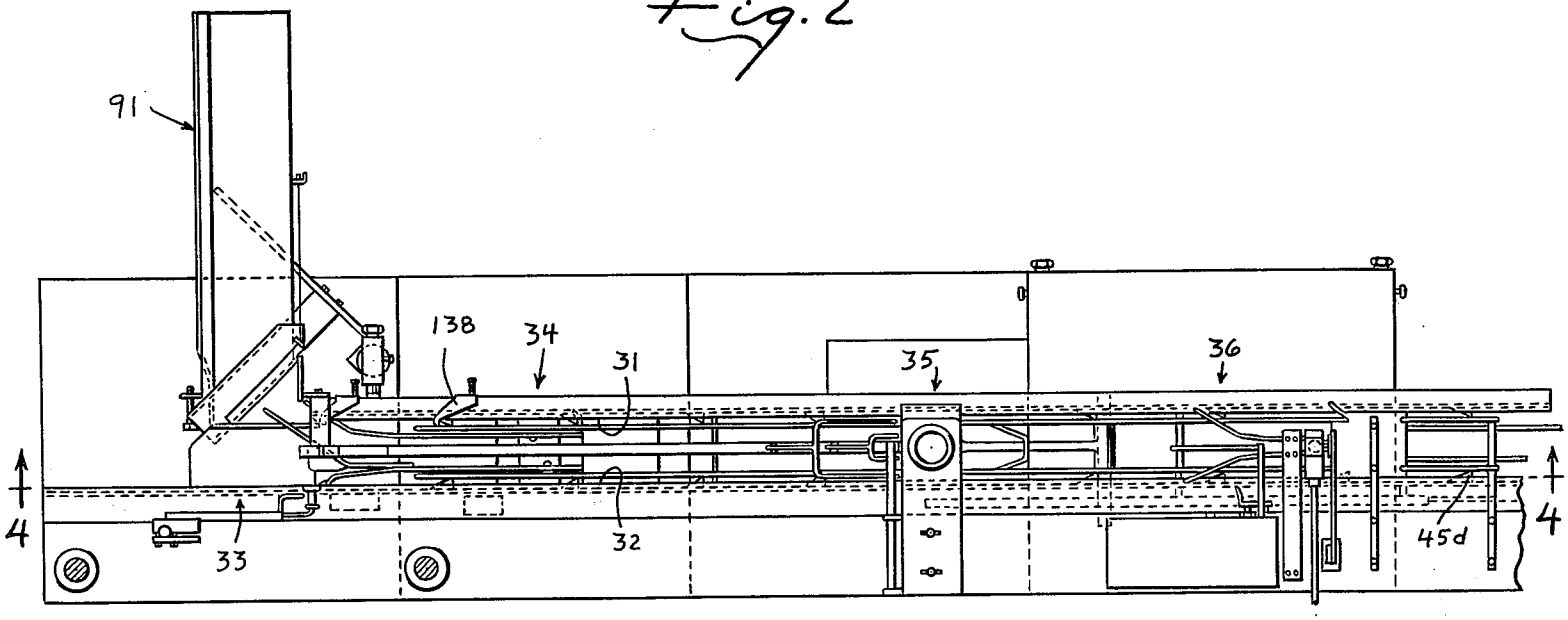
FIG. 2 is a top plan view of the packaging machine.
Figure 3:
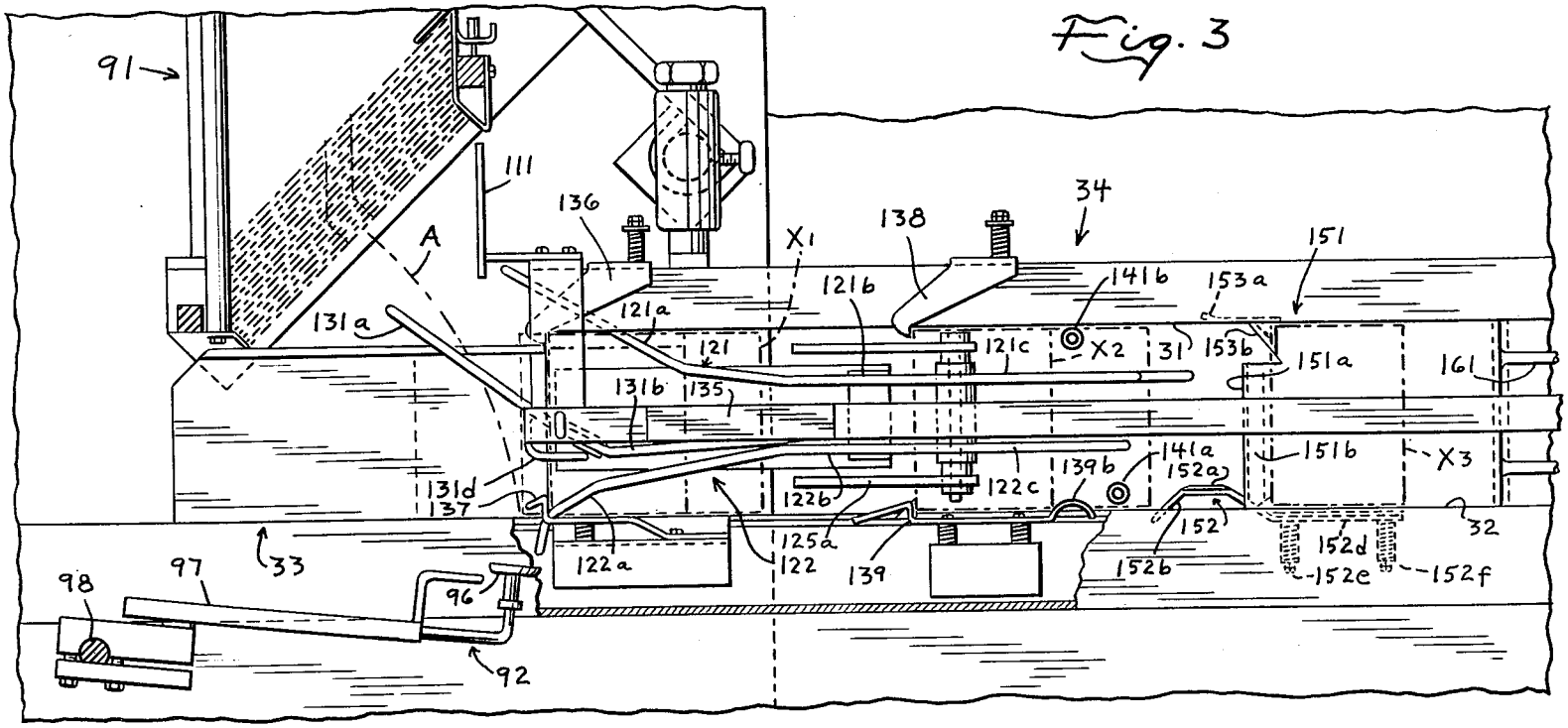
FIG. 3 is a fragmentary top plan view showing an inlet portion of the packaging machine on a larger scale than FIG. 1.
Figure 3A:
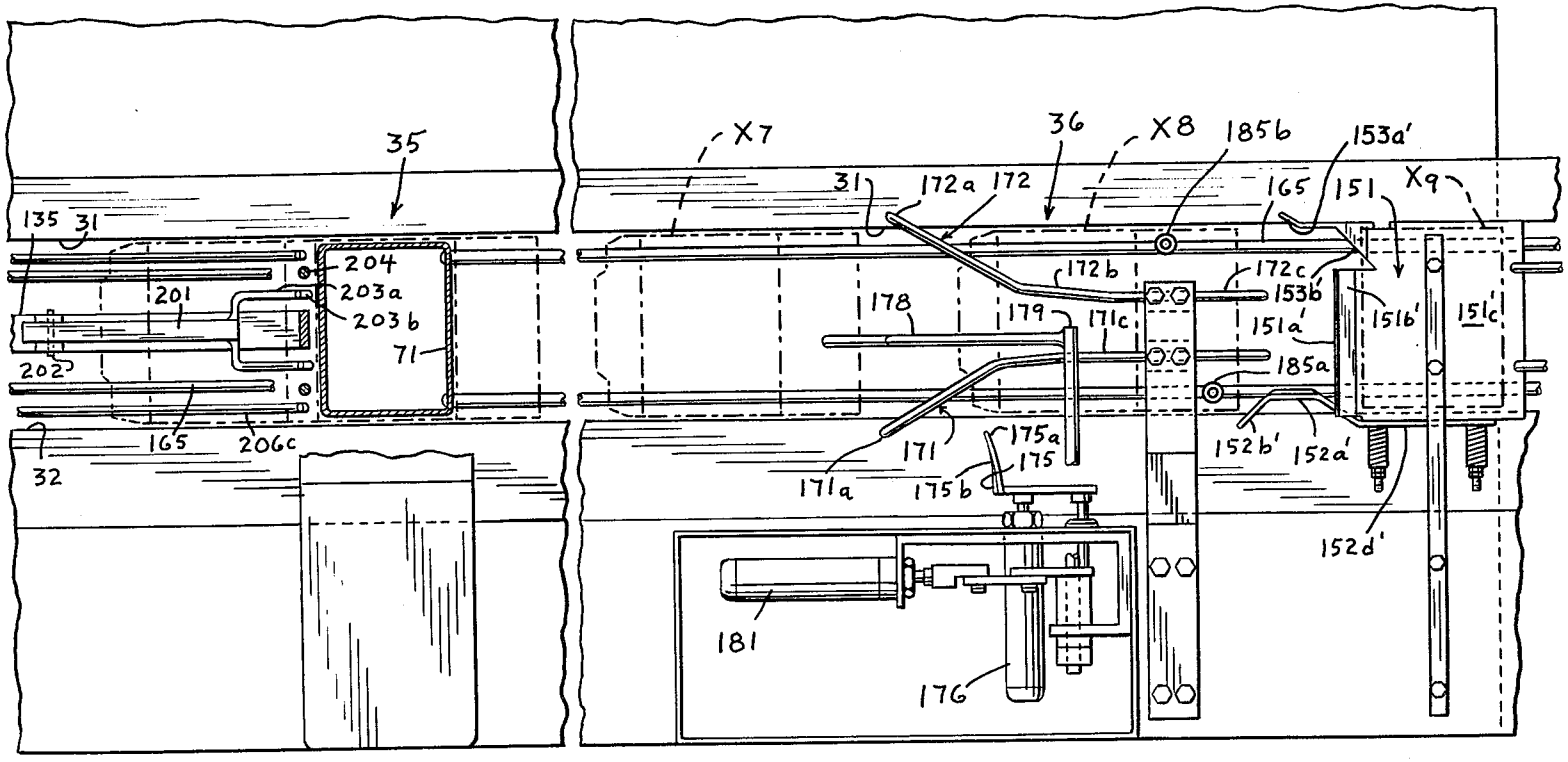
Figure 4:
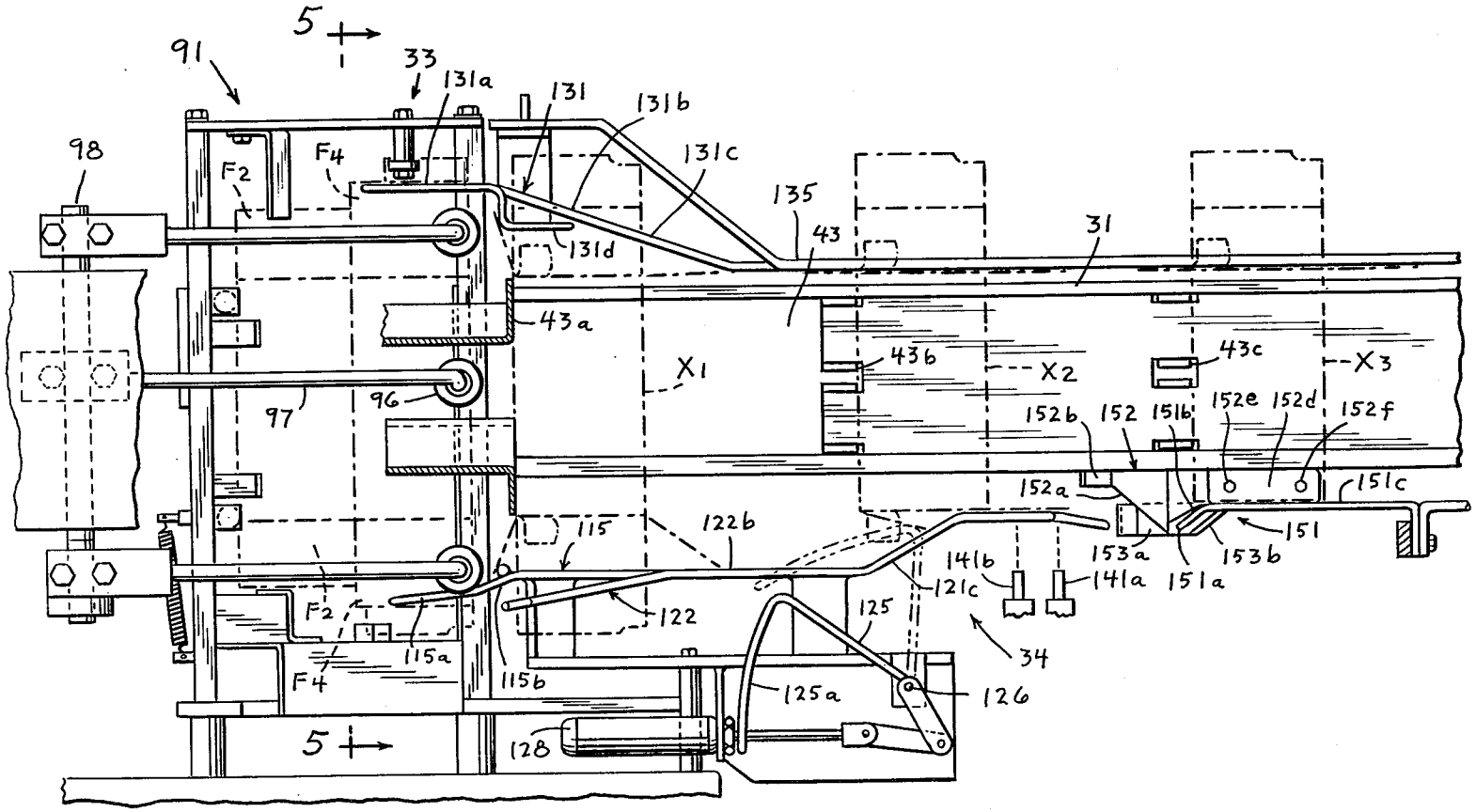
Figure 4A:
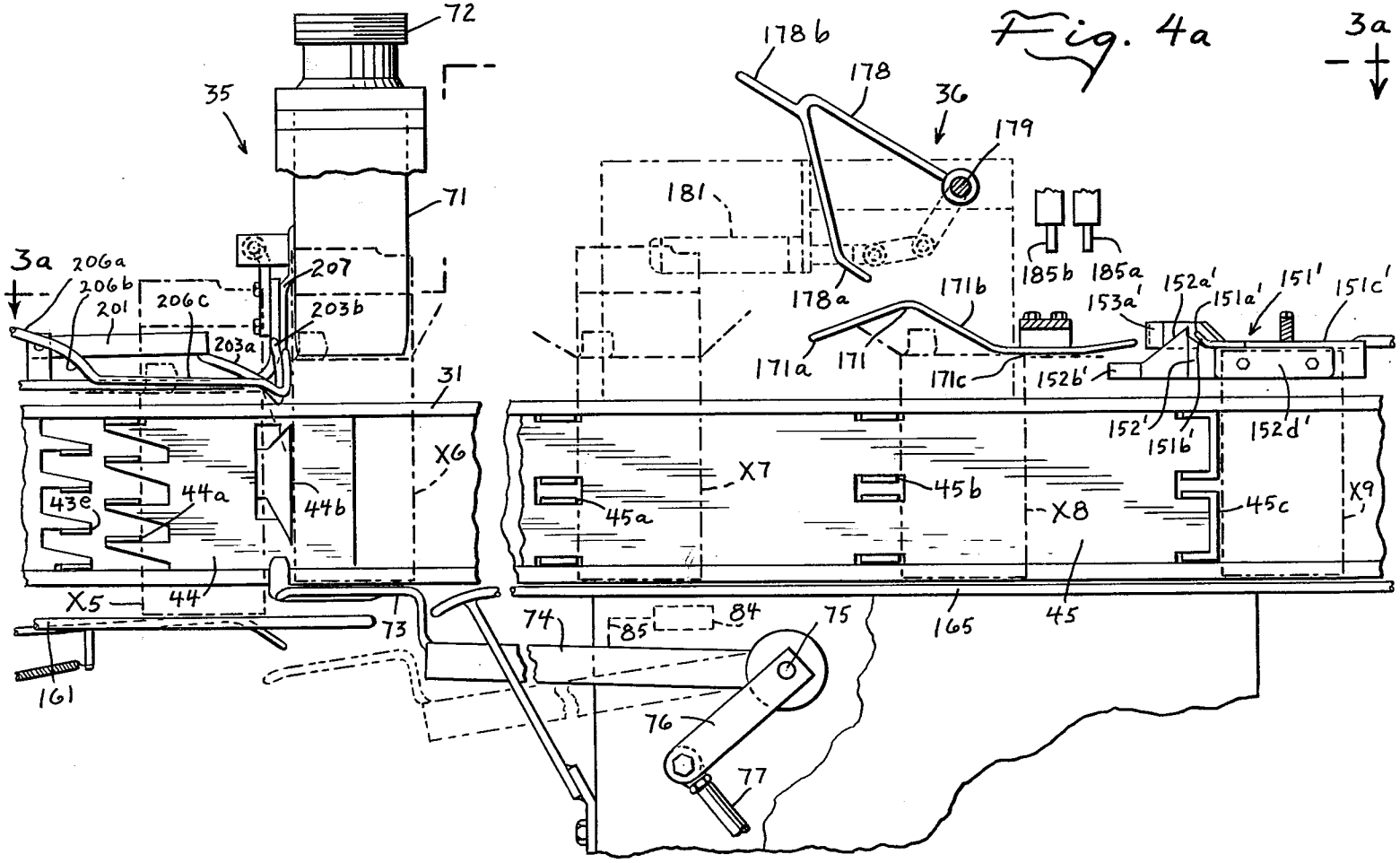
Figure 5:
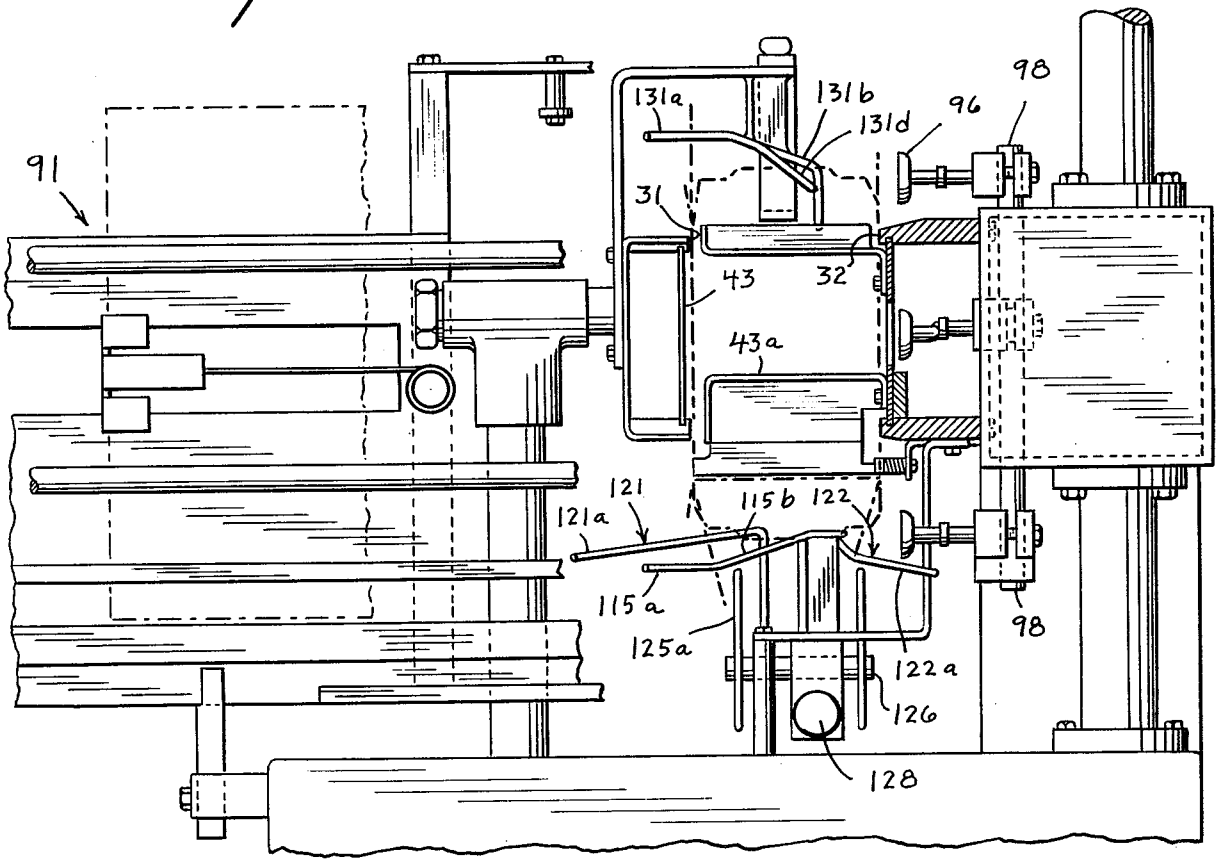
Figure 10:
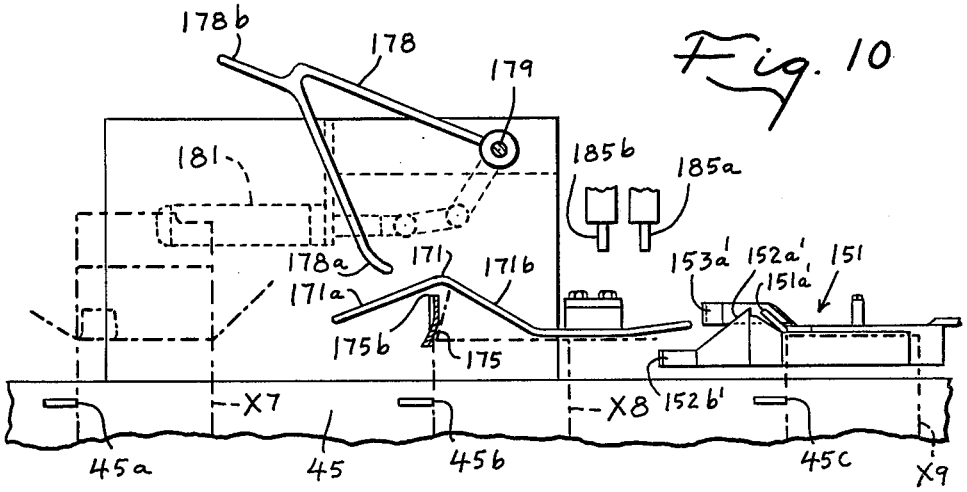
Figure 11:
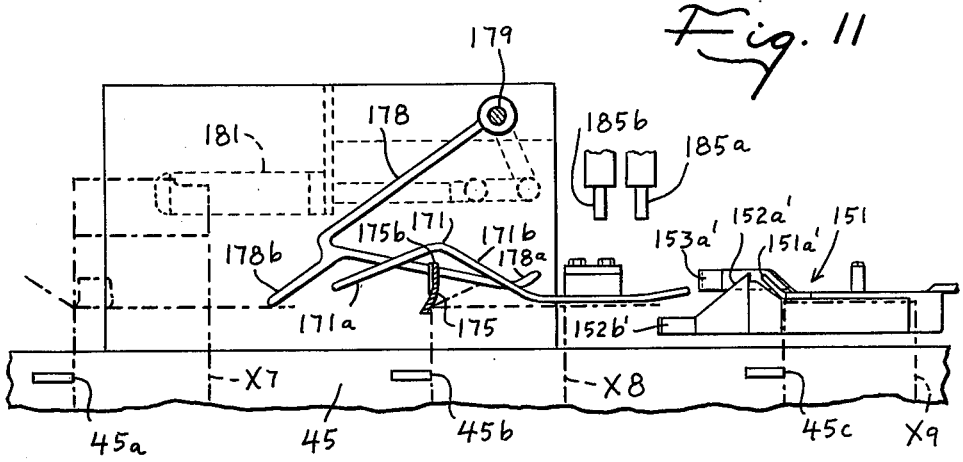
Figure 12:
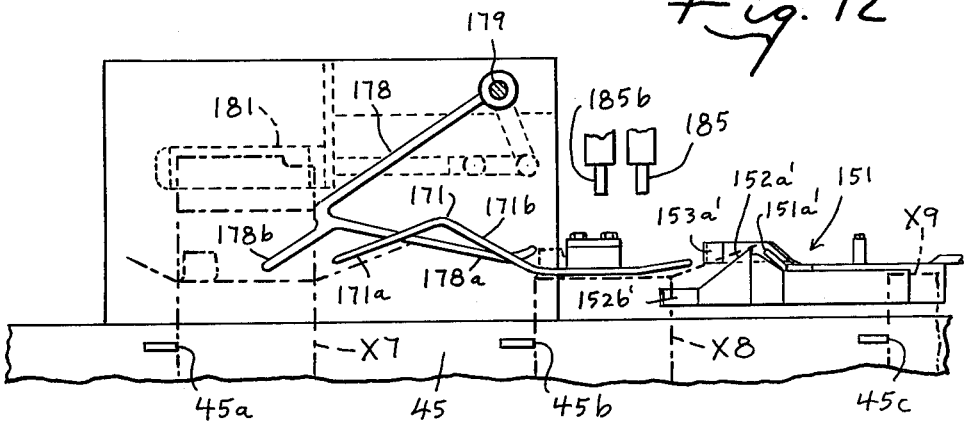
Figure 13:
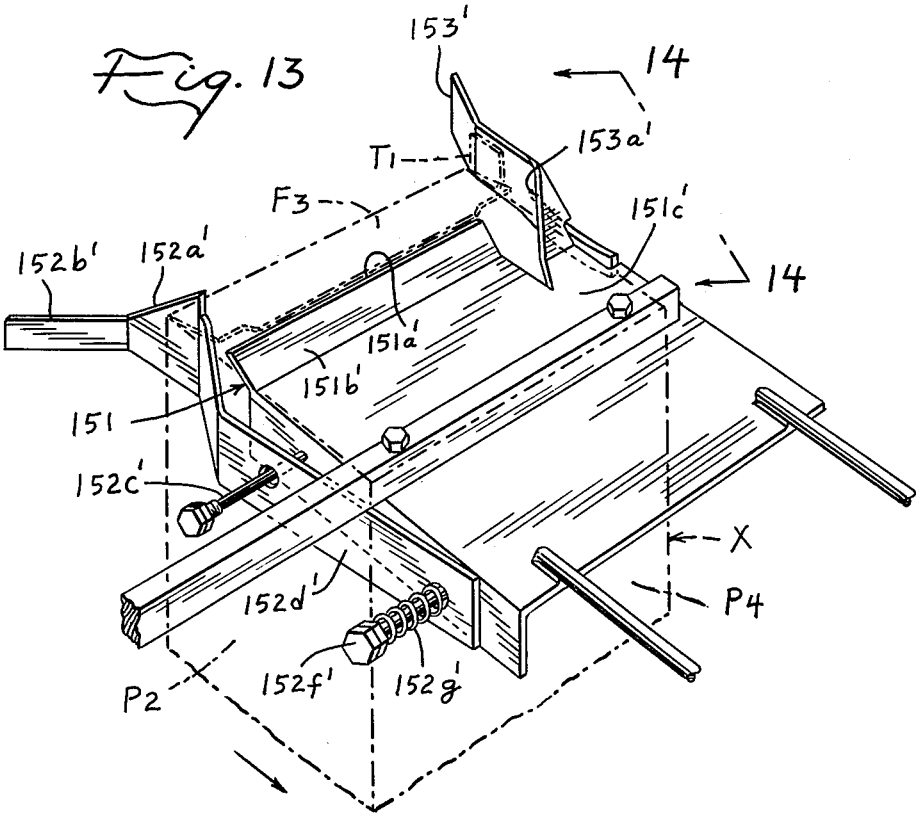
Figure 14:
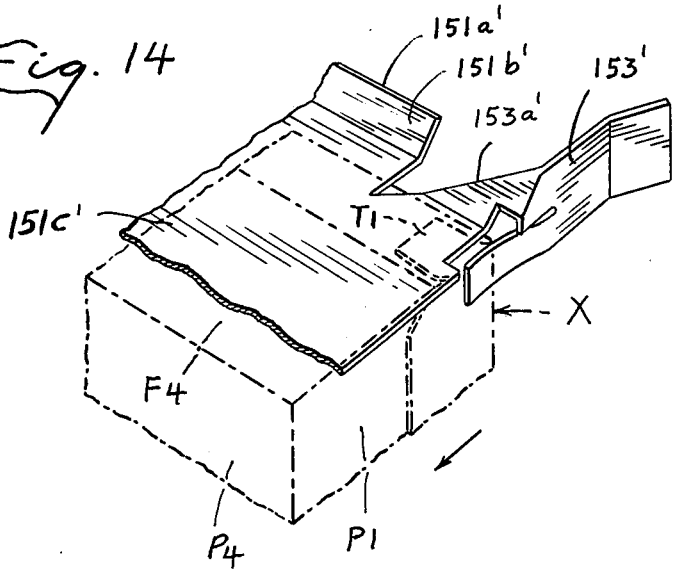
Figure 15:
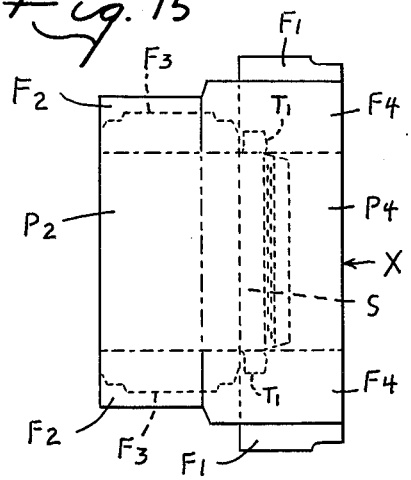
Figure 16:
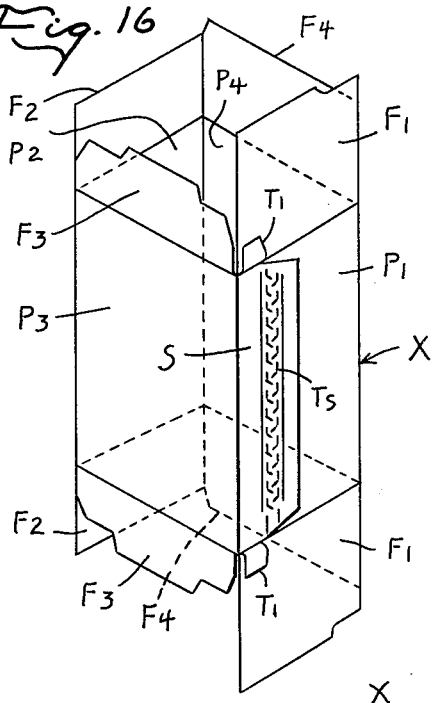
Figure 17:
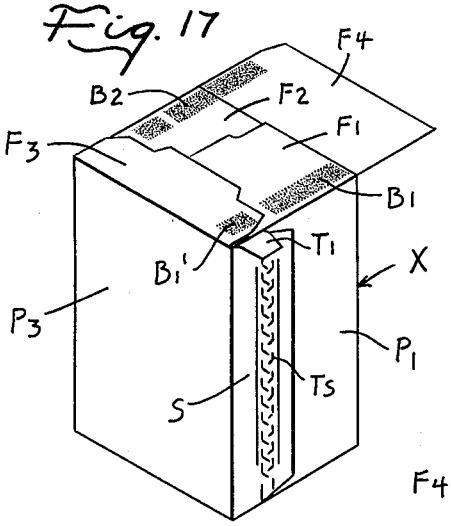
Figure 18:
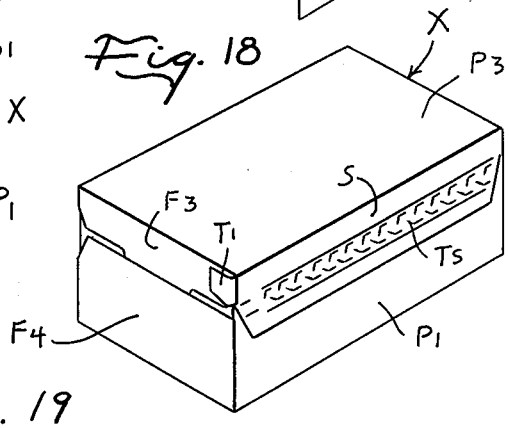
Figure 19:
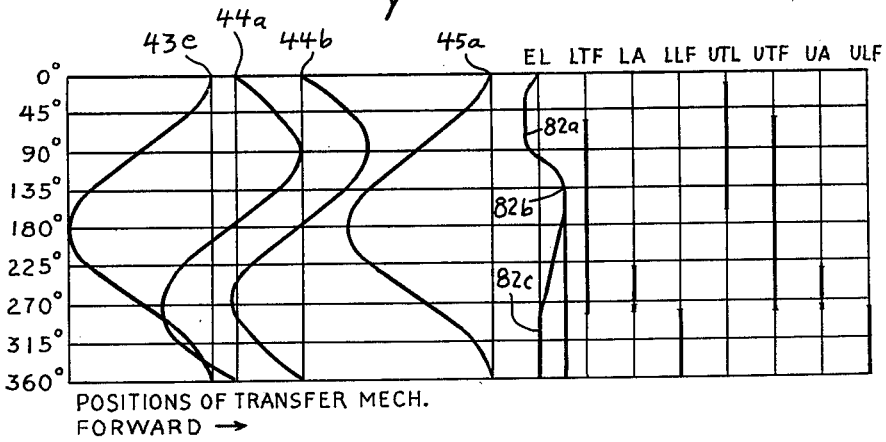
Figure 20:
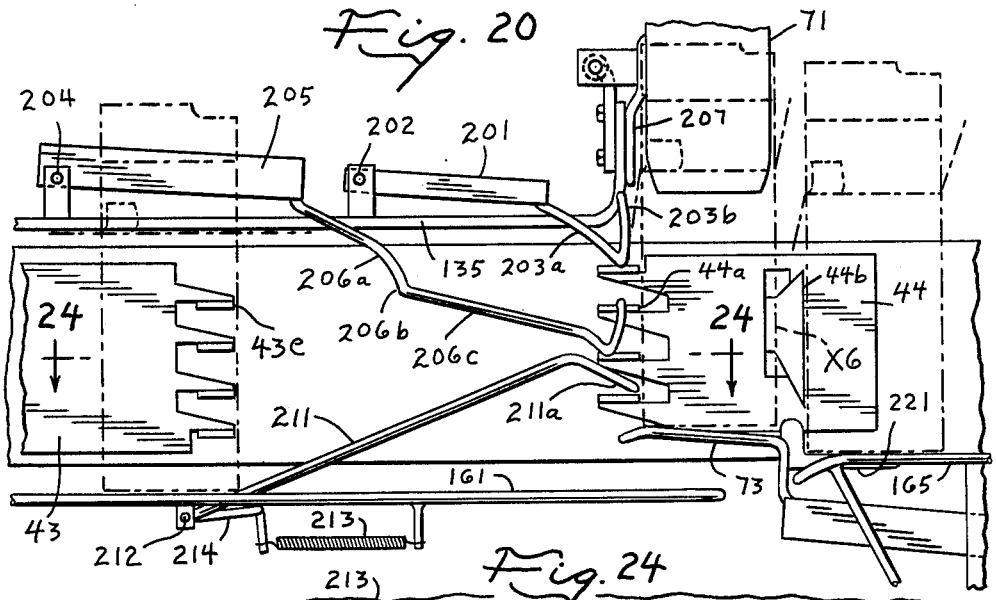
Figure 24:
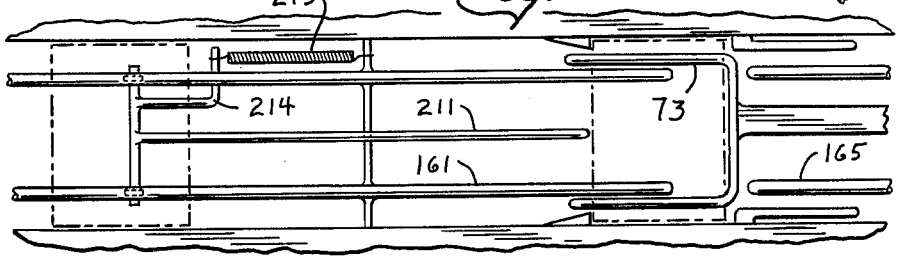

FIG. 3*a* is a fragmentary top plan view showing an outlet portion of the packaging machine on a larger scale than FIG. 1;

FIG. 4 is a fragmentary vertical sectional view taken on the plane 4—4 of FIG. 2, showing an inlet portion of the packaging machine on a larger scale than FIG. 2;

FIG. 4*a* is a fragmentary vertical sectional view taken on the plane 4—4 of FIG. 2 showing an outlet portion of the packaging machine on a larger scale than FIG. 2;

FIG. 5 is a fragmentary end elevational view of the packaging machine taken on the plane 5—5 of FIG. 2, showing the parts on a larger scale than FIG. 2;

FIGS. 6, 7, 8 and 9 are fragmentary horizontal sectional views taken on the plane 6—6 of FIG. 1 and illustrating the carton infeed mechanism in different moved positions;

FIGS. 10, 11 and 12 are fragmentary vertical sectional views taken on the plane 10—10 of FIG. 3*a* and illustrating the upper flap closing mechanism in different moved positions;

FIG. 13 is a fragmentary perspective view of a lead flap folding mechanism;

FIG. 14 is a fragmentary perspective view taken on the plane 14—14 of FIG. 13 and illustrating the tab folding mechanism;

FIG. 15 is a side view of a carton blank adapted to be erected and filled by the packaging machines;

FIG. 16 is a perspective view of the carton in an erected condition in an end-to-end inversion of the position of the carton during advance through the packaging machine;

FIG. 17 is a perspective view of the carton and illustrating the carton in a partially closed condition;

FIG. 18 is a perspective view of the carton in a closed condition;

FIG. 19 is a timing diagram for the packaging machine;

FIGS. 20, 21, 22 and 23 are fragmentary vertical sectional views through the packaging machine adjacent the carton filling station and illustrating different moved positions; and FIG. 24 is a fragmentary horizontal sectional view taken on the plane 24—24 of FIG. 20.

The present invention relates to an intermittently cycled packaging machine which is arranged to take carton blanks that are initially supplied in a flattened condition, erect the carton and close and seal the lower end of the carton with hot melt adhesive; fill the carton, and thereafter close and seal the upper end of the carton with hot melt adhesive, the intermittently cycled packaging machine is particularly adapted for erecting, filling and closing cartons of the type shown in FIGS. 15–18 and designated generally by the letter X.

The cartons are formed of paper board or the like and include opposed narrow side panels P1 and P2 interconnected along fold lines to wide side panels P3 and P4. Upper and lower end flaps F1–F4 are articulated along fold lines to the upper and lower ends of the panels P1–P4 respectively. The ends of the carton are adapted to be closed and sealed with hot melt adhesive when the end flaps are folded in a particular sequence and the adhesive is applied in a particular adhesive pattern. More particularly, when closing an end of the carton, the end flaps F1–F2 on the narrow side panels P1 and P2 are adapted to be infolded first to at least substantially close the end of the carton followed by infolding of the end flap F3 on the wide side panel P3. Thereafter, hot melt adhesive is applied on the infolded end flaps in bands such as designated B1 and B2 in FIG. 17 that parallel the narrow side panels, and the end flap F4 on the other wide panel P4 is thereafter folded inwardly and onto the adhesive. The end flaps F4 on the wide side panel P4 are dimensioned so that, when infolded last, they overlap portions of the other end flaps F1–F3 on the respective end of the carton as shown in FIG. 18.

The carton is preferably of a so-called chest-type in which one of the wide side panels P3 functions as a cover, when the carton rests on its other wide side panel P4 as shown in FIG. 18. The wide side panel P3 has a sealing flap S articulated along one lengthwise edge and secured as by adhesive to the narrow side panel P1. In order to facilitate opening of the carton, a tear strip TS may be formed in the seal flap S, by discontinuous cut lines in a manner well known in the art. In order to provide a flanged cover when the carton is opened, end tabs T are advantageously provided on the ends of the seal flap S and arranged to be infolded and sealed by a spot of hot melt adhesive, to respective ones of the end flaps F3 on the wide side panel P3.

The intermittently cycled packaging machine includes laterally spaced carton guides 31 and 32 spaced apart a distance to receive the cartons X with the wide side panels P3 and P4 extending crosswise therebetween, and for guiding the cartons along a path from the carton infeed station 33 past a lower carton closing station 34 to a carton filling station 35, and for guiding filled cartons from the carton filling station past an upper carton closing station 36. A carton transfer means is mounted for extension and retraction along the lateral guides 31 and 32 and have a plurality of carton engaging means at spaced locations therealong and which are operative when the transfer means is driven through a transfer cycle to advance a series of cartons along the path between the lateral carton guides in a forward step. The transfer means and the drive for the packaging machine is preferably of the type disclosed in U.S. Pat. No. 3,364,651 issued Jan. 23, 1968 and entitled "Packaging Apparatus", the disclosure of which is incorporated by reference for a more complete disclosure of the construction and operation of the transfer mechanism and the drive mechanism for the packaging machine. As more fully disclosed in the aforementioned patent, the transfer mechanism is of the reciprocating type and includes slides mounted for reciprocation along the lateral carton guides 31 and 32. In that patent, the carton transfer slides are formed in a plurality of slide sections including an inlet slide section 43 that extends from a location adjacent the carton infeed station 33 past the lower carton closing station 34 to a location adjacent the carton filling station 35; an intermediate slide section 44 adjacent the filling station 35; an outlet slide section 45 that extends from location adjacent the carton filling station past the upper carton closing station 36 to the outlet end of the lateral carton guides. The inlet slide section 43 has a plurality of carton pushers designated 43*a*–43*e* at spaced locations therealong to advance cartons in step fashion from the carton infeed station 33 to a location in advance of the filling station 35. The intermediate slide section 44 has two sets of pushers 44*a* and 44*b* for respectively moving an empty carton to a position below the filling nozzle and for moving a filled carton away from the filling nozzle. The outlet slide 45 has a plurality of carton pushers 45*a*–45*d* at spaced locations therealong arranged to advance cartons in step fashion from a location adjacent the outlet side of the filling station past the upper carton closing station and to the outlet end of the machine. As disclosed in that patent, the inlet and outlet sections 43 and 45 are reciprocated in unison with each other and the intermediate section 44 is reciprocated in timed relation with the inlet and outlet sections but 90° out of phase therewith. As shown in FIG. 1, the several slide sections are reciprocated by a crank 51 connected to the output shaft 52 of a one revolution clutch 53 driven from a suitable motor (not shown). The crank 51 is connected through a link 55 to one end of a lever 56 that is pivoted intermediate its ends at 57, and the other end of the lever is connected through a link 58 to members (not shown) attached to the inlet and outlet slide sections 43 and 45 to reciprocate them in unison. The intermediate slide section 44 is driven from the crank 51 through a link 61 connected to one end of a lever 62 that is pivoted intermediate its ends at 63 to the frame and which is connected through a link 64 to members (not shown) attached to the intermediate slide sections to reciprocate the intermediate slide sections 90° out of phase with the inlet and outlet slide sections. The one revolution clutch mechanism arranged to normally stop the crank 51 in the position shown in FIG. 1 and, when the crank is in its stop position, the inlet and outlet slide sections 43 and 45 are in their forward position and the intermediate slide section 44 is intermediate its forward and rear positions. Thus, as shown in the timing diagram of FIG. 19, the pusher 43*e* on the inlet slide section and the pusher 45*a* on the outlet slide section are in full forward position when the crank is in its 0° position shown in FIG. 1, and at 0°, the pushers 44*a* and 44*b* of the intermediate slide section are in their intermediate position. When the clutch is engaged, it drives the crank through one revolution and back to the position shown in FIG. 1 to thereby reciprocate the inlet and outlet slide sections in timed relation with the intermediate slide section. The multiple slide section transfer mechanism disclosed in the aforementioned patent is advantageous in that it enables rapid acceleration of the filled carton away from the filling station and rapid advance of the succeeding carton to the fill station while allowing relatively slower acceleration and deceleration of three cartons as they are advanced by the inlet and outlet slide sections 43 and 44.

The filling machine has a downwardly opening filling nozzle 71 having a cross-section similar to and slightly smaller than the cross-section of the carton and which is adapted to dispense semi-fluid or plastic material such as semi-frozen ice cream, sherbert or the like in a continuous stream. The nozzle is adapted for connection, as by a fitting 72 to a conduit leading to a continuous type freezer or the like (not shown). In order to avoid interference with the semi-fluid product that is continuously emerging from the nozzle, the cartons are advanced to the filling station at a level with the tops of the cartons spaced somewhat below the nozzle as shown in FIG. 4*a*, and the cartons are then raised at the filling station by a carton elevator 73 which moves the cartons into at least partially telescoping relation with the nozzle. The carton elevator and drive therefor is also of the type disclosed in U.S. Pat. No. 3,364,651 to which reference is made for a more complete disclosure. In general, the carton elevator is operated in timed relation with the transfer mechanism and, as best shown in FIG. 1, the carton elevator 73 is supported on a lever 74 that is swingably supported by a shaft 75 on the frame of the machine. An arm 76 is connected to the shaft 75 and through a link 77 to an L-shaped lever 78. One end of the L-shaped lever is pivotally mounted at 79 on the frame and the other end of the lever has a follower 81 that engages a cam track 82 on a cam secured to the output shaft of the one-revolution clutch 53. In its dwell or 0° position shown in FIG. 1, the follower 81 is disposed adjacent the end of a relatively wide portion 82*c* of the cam track and the cam track is shaped so that, when the cam is driven through one revolution, the portion 82*a* of the cam track will first move the elevator down to a position below the level of the bottom of the incoming empty carton and the portion 82*b* will thereafter raise the elevator to lift the carton into telescoping relation with the nozzle after the transfer mechanism has advanced the empty carton into a position below the nozzle, and the follower thereafter moves into a wide portion 82*c* of the cam track 82 where the elevator is allowed to move downwardly with the carton as it is filled. As diagrammatically shown in FIG. 4*a*, a switch 84 for actuating the one-revolution clutch is operated as through a switch actuator 85 herein shown connected to the elevator lever 74, when the carton being filled at the filling station moves downwardly to a level in which the top of the carton is adjacent the lower end of the nozzle. Actuation of the switch 84 operates the one-revolution clutch to drive the crank 51 and cam track 82 through one revolution. Thus, the machine is driven through a cycle each time a carton is filled.

As best shown in FIGS. 2 and 3, one of the lateral carton guides 32 is relatively longer than the other lateral carton guide 31 and extends across the carton infeed station 33. A carton magazine 91 is provided to support a stack of flattened carton blanks with the end carton blank in the stack disposed at an acute angle to the lateral carton guide 32 and spaced laterally therefrom, and a carton infeed mechanism 92 is provided for feeding carton blanks from the stack and for opening and squaring the cartons. The carton infeed mechanism includes vacuum operated grippers 96 mounted on arms 97 carried by an upright shaft 98 for swinging movement about the axis of the shaft 98 through an angle between a position in which the grippers engage the face of the end carton blank in the stack and a position in which the grippers are positioned alongside the first lateral carton guide 32. The magazine 91 and carton feed means 92 are conveniently of the type disclosed in U.S. Pat. No. 3,418,893, to which reference is hereby made for a more complete description. As shown in FIG. 1, the carton infeed mechanism is operated in timed relation with the transfer mechanism from a cam track 102 that rotates with the output shaft 52 of the one-revolution clutch 53, which cam track engages a follower 103 and operates a pivotally mounted lever 104 that is connected through a link 105 to a lever on the shaft 98 for swinging the vacuum operated grippers as the cam 102 is rotated through one revolution. In general, the vacuum operated grippers are moved from a position as shown in FIG. 3 alongside the lateral carton guide 32 through an angle into engagement with the end carton in the stack in the magazine 91 during retraction of the inlet slide 43 and are then swung back to the position shown in FIG. 3 before the slide reaches its full forward position.

Figure 6:
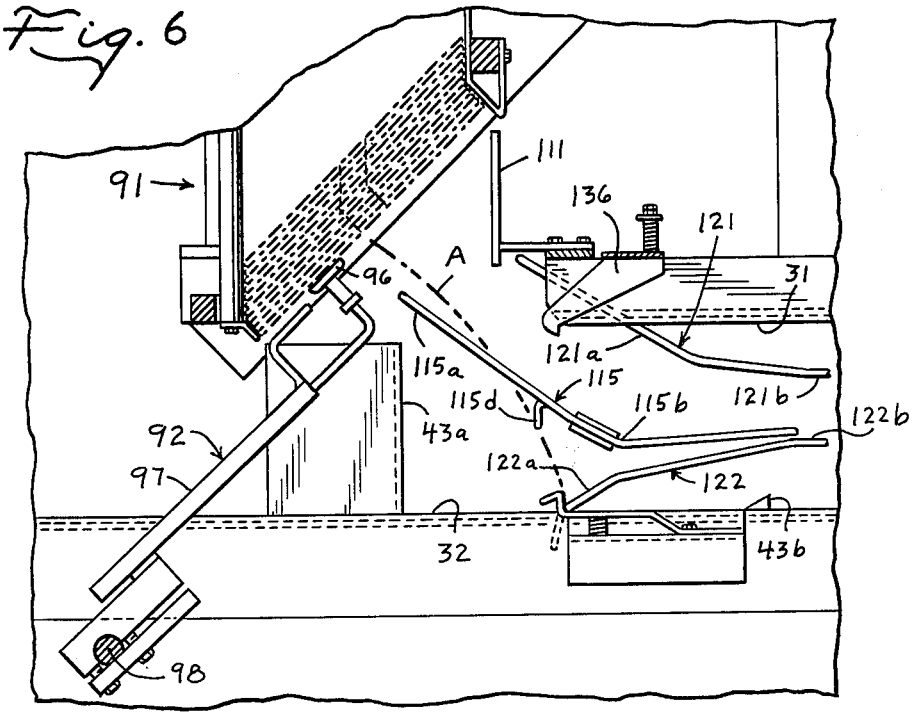
Figure 7:
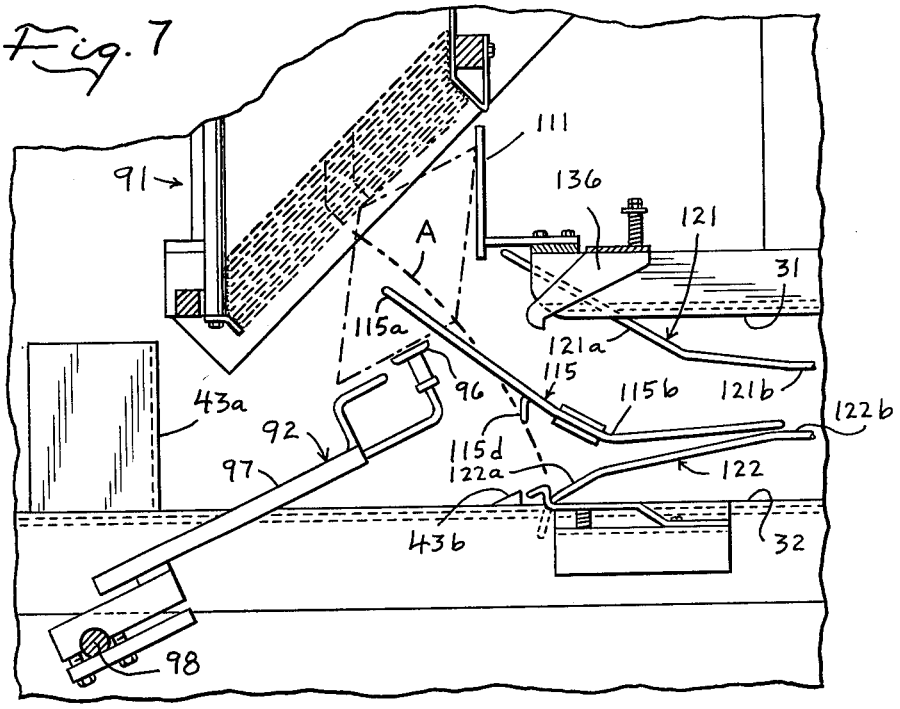
Figure 8:
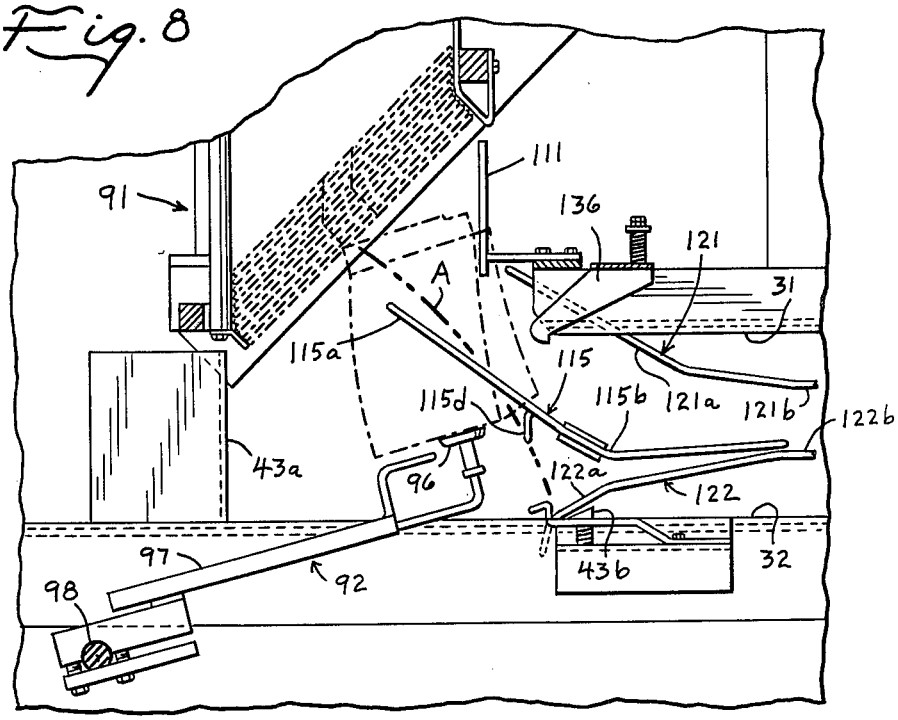
Figure 9:
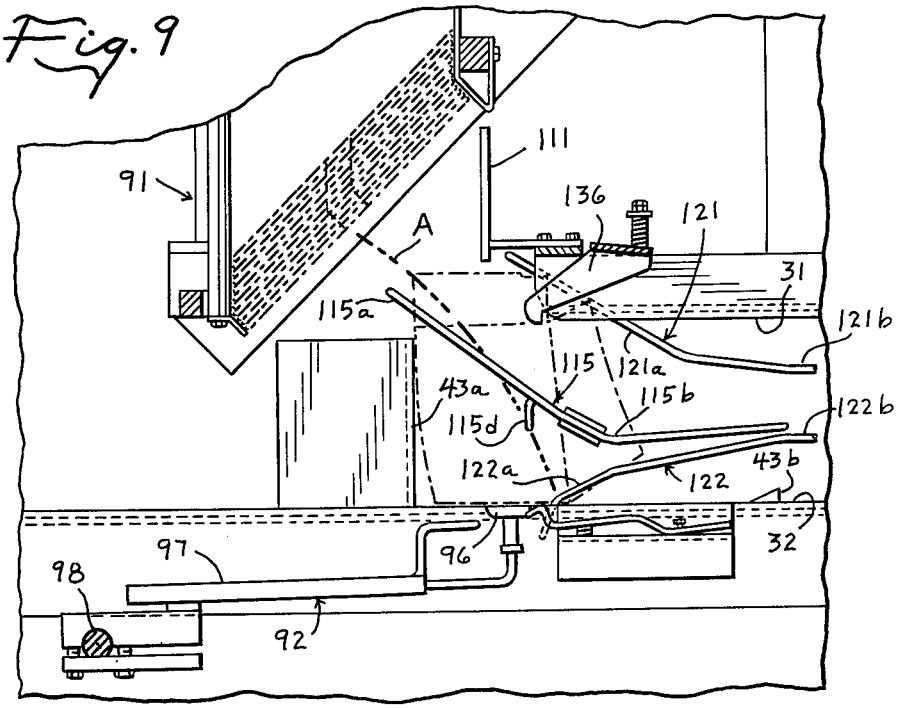

The cartons are fed from the magazine to the transfer mechanism in a manner to cause the end flaps F4 on the upper and lower ends of the panel P4 to lead during advance of the cartons through the packaging machine. For this purpose, the blanks for forming the cartons X are stored in the magazine so that the panels P2 and P4 of the end carton blank are exposed at the end of the stack with the panel P2 located closer to the apex of the angle than the panel P4. The vacuum operated grippers 96 are arranged to engage the panel P2 and the upper and lower end flaps F2 of the end carton blank in the stack as shown in FIG. 6, and to move the side panel P2 off the stack and through an angle to a position alongside the lateral carton guide 32, as shown in FIGS. 7–9. The adjacent side edges of the end flaps F2 and F4 on the upper and lower ends of the carton move through an arc designated A in FIGS. 3 and 6–9 as the side panel P2 is moved from its position at the end of the stack as shown in FIG. 6 to its position alongside the lateral carton guide 32 as shown in FIG. 9. A carton panel engaging member 111 is provided adjacent the end of the other lateral carton guide 31 and extends transverse thereto at a location to engage the panel P4 on the carton as it is moved off the stack and to a position alongside the lateral carton guide, to open and square the carton as shown in FIGS. 7 and 8.

Closing of the lower ends of the cartons X requires that the end flaps F1 and F2 on the lower ends of the narrow side panels P1 and P2 be infolded first and, in order to facilitate infolding of the narrow end flaps, provision is advantageously made for deflecting the lower end flap F4 forwardly and the lower end flap F3 rearwardly prior to infolding of the flaps F1 and F2. As shown in FIG. 16, the end flaps F4 at opposite ends of the side panel P4 are relatively longer than the end flaps F2 at opposite ends of the panel P2. In accordance with the present invention, an elongated lower lead flap guide member 115 (FIGS. 4 and 6–9) is provided for deflecting the lower end flap F4 laterally of panel P4, as the carton is moved off the magazine into a position alongside the lateral carton guide 32. As best shown in FIGS. 6–9, the lower lead flap guide member 115 has an inlet end disposed radially inwardly of the arc of travel A of the adjacent side edges of the lower end flaps F2 and F4 and the guide member extends from its inlet end along a line as viewed in plan that intersects that arc and then terminates at an outlet end that is outwardly of the arc A. As shown in FIG. 4, the inlet end portion **115*a* of the lower lead flap guide member is disposed at a level below the lower end of the lower end flap F2 and above the lower end of the lower end flap F4 to allow the lower end flap F2 to pass thereabove while engaging and guiding the end flap F4 laterally of its panel P4. The lower lead flap guide member 115 converges upwardly in a region outwardly of the arc A toward the level of the lower ends of the cartons to further deflect the lower lead flap F4 forwardly. A lower trail flap deflecting finger 115*d* is advantageously provided on the lower lead flap guide at a level to engage the trail flap F3 on the lower end of the carton, as the carton is advanced by the pusher 43*a* on the infeed slide 43. In this manner, the lead and trail flaps on the lower ends of the cartons are deflected forwardly and rearwardly respectively to facilitate infolding of the lower end flaps F1 and F2 on the panels P1 and P2** and to also rigidify the respective panel.

First and second lateral flap folding devices are provided for infolding the end flaps F1 and F2 on the lower end of the carton. The first and second lateral flap folding devices are preferably in the form of first and second elongated lower flap guide members 121 and 122 that are disposed below the lower ends of the panels on the carton at the lower carton closing zone, and which lower flap guide members have portions **121*a* and 122*a* that converge in the direction of advance of the cartons relative to each other as shown in FIGS. 6–9 and relative to a level spaced below the lower ends of the cartons a distance approximately equal to the length of the lower trail flap F2, as shown in FIG. 4. The lower flap guides also have portions 121*b*, 122*b* that extend lengthwise of the path of movement of the cartons at a level spaced below the lower ends of the cartons a distance approximating the length of the lower trail flap F2, and outlet end portions 121*c* that converge upwardly to the level of the lower ends of the panels on the cartons. The outlet portions 121*c* guide the partially infolded lower flaps F1 and F2 into a position closing the lower end of the carton and simultaneously guide the flap F4 at the lead side of the carton forwardly of the panel P4**.

A movable lower trail flap folding mechanism is provided for infolding the lower trail flap F3. The movable trail flap folding mechanism includes a pair of arms 125 (FIG. 4) mounted on a shaft 126 for swinging movement in a generally upright plane, and the arms have elongated flap engaging portions **125*a* spaced outwardly from the shaft 126 a distance to extend somewhat above the guide portion 121*c*, when the flap folding members are in their raised position as shown in dotted lines in FIG. 4. The flap folding members 125 are moved between their lower and raised positions by an actuator 128 such as a pneumatic actuator and the flap folding members are operated in timed relation with the transfer mechanism as by a suitable cam in a sequence controller 130 (FIG. 1) driven in timed relation with the clutch output shaft 52. The flap folding members 125 are normally positioned in their lower position during the dwell period of the packaging machine and, as shown by the heavy portion of the line designated LTF in the timing diagram of FIG. 19, the lower trail flap folders are moved to their raised position during retraction of the inlet slides 43 to engage the lower trail flap F3 and fold it forwardly as shown in phantom in FIG. 4, and the lower trail flap folders remain in their raised position during a portion of the subsequent forward movement of the inlet slides, until the carton being advanced by the pusher 43***b* reaches a position somewhat in advance of the position shown at carton dwell position X2 in FIG. 4. The flap engaging members 125 are then moved downwardly out of the path of the lower trail flap on the next succeeding carton as it advances to carton position X2.

As best shown in FIG. 3, carton stops 136 and 137 are provided for preventing retrograde movement of the cartons in the position shown at carton dwell position X1, during retraction of the slide and another set of carton stops 138 and 139 are provided for preventing retrograde movement of the cartons at the carton dwell position X2. These carton stops are yieldably biased inwardly of the lateral carton guides and have abrupt shoulders on their trail sides for engaging the carton to prevent retrograde movement, with cam faces on the inlet side to cam the stops laterally outwardly of the guides during advance of the cartons. The carton stop 139 additionally has a nose portion 139*b* engageable with the trail side of the carton at carton dwell position X2, to laterally stabilize the carton during infolding of the trail flap on the lower end of the carton.

A lower hot melt adhesive applying mechanism is provided for applying hot melt adhesive to the infolded end flaps on the lower end of the carton in bands that generally parallel the narrow side panels P1 and P2 as the carton is advanced. The lower hot melt adhesive applying apparatus includes a pair of valved nozzles 141*a* and 141*b* which have valve actuators such as pneumatic actuators that are selectively operable to open the valves in the nozzles and dispense a stream of hot melt glue. The valved nozzles and the hot melt adhesive heating and pumping system may, for example, be of the type shown in U.S. Pat. No. 3,815,788 to which reference is made for a more complete description of the overall hot melt adhesive dispensing system.

The valved nozzles 141*a* and 141*b* are located below the cartons and are operative when actuated to dispense streams of hot melt adhesive upwardly against the underside of the infolded end flaps and are laterally positioned to direct their streams of hot melt adhesive on the involved end flaps in strips adjacent the narrow side panels P1 and P2, as the cartons are advanced past the adhesive applying nozzles. The nozzles are positioned somewhat downstream of the trail flap folding mechanism and from the carton dwell position X2. Operation of the valved nozzles 141*a* and 141*b* is controlled by a suitable cam in the aforementioned sequence controller 130 and, as shown by the heavy portion of the line designated LA in the timing diagram of FIG. 19, the valves in the lower valved nozzles are opened only after the inlet carton transfer slide 43 has started movement of the cartons in a forward stroke and the valved nozzles are held open for a time interval sufficient to apply a strip of adhesive to the end flaps on the lower end of the carton as the carton is advanced a distance approximating the desired length of the band of adhesive. The packaging machine is particularly adapted to close and seal cartons of the type shown in FIGS. 15–18 and which are formed with end tabs T1 on the seal flap S, which end tabs must be sealed to the end flaps F3 on the panel P3, to form a cover flange. One of the valved nozzles 141*b* is arranged to apply adhesive to an area on the lower end flap F3 adjacent the narrow side panel P1, as indicated at B1′ in FIG. 17. The application of adhesive to the lower end flap F3 is conveniently effected through this same valved nozzle 141*b* that applies the strip of adhesive in the area B1 on the lower end flap F1 by extending the length of the band B1 as indicated at B1′. Preferably, the valved nozzle 141*b* is momentarily turned off and then back as the edge of the flap F3 passes the nozzle 141*b* to avoid application of adhesive adjacent the edge of that flap. Valved nozzle 141*a* does not have to dispense adhesive onto the trail flaps F3 and a separate means can be utilized to control the valved nozzle 141*a* and to dispense a shorter strip of adhesive. However, in order to simplify construction, the same cam means in the sequence controller 130 can be utilized for controlling both the valved nozzles 141*a* and 141*b* to open them for the same time interval, provided the nozzle 141*a* is offset forwardly relatively to the path of travel of the cartons so that its strip of adhesive B2 will commence on the underside of the lower lead flap F4 and terminate on the lower flap F2, adjacent the infolded trail flap F3 as shown in FIG. 17. The additional adhesive applied in the strip B1 to the underside of the lower flap F4 does not adversely affect sealing of the carton by the hot melt adhesive.

The hot melt adhesive sets rapidly and a lower lead flap folding mechanism 151 is provided for rapidly infolding the lower lead flap F4 onto the adhesive on the previously infolded lower end flaps F1–F3, to spread the strip of adhesive and seal the flaps in a closed condition. The lower lead flap folding mechanism is arranged to infold the lower lead flap in response to advance of the carton therepast and the lower lead flap folding mechanism is positioned in sufficiently close proximity to the adhesive applying nozzles 141*a* and 141*b* and in relation to the carton dwell positions and stroke of the transfer mechanism so that the transfer mechanism is operative during each transfer cycle to advance a carton past the lower adhesive applying nozzles 141*a*, 141*b* and past the lower lead flap folding mechanism 151 in a continuous forward step. The transfer mechanism is shown in its rest or dwell positions in FIGS. 3 and 4 and, in the transfer mechanism dwell position, one carton is positioned at carton dwell position X2 in advance of the adhesive applying nozzles 141*a* and 141*b* and a preceding carton is positioned at carton dwell position X3, downstream of the lower lead flap folding apparatus 151. Thus, when the transfer mechanism is operated through a cycle, it advances a carbon from the carton dwell position X2 past the lower adhesive applying nozzles 141*a* and 141*b* and past the lower flap folding mechanism 151 to the carton dwell position X3 in a single forward stroke. The cartons move very rapidly during the forward stroke of the transfer mechanism and the application of adhesive and infolding of the lower lead flap occurs in a very short time interval and before the applied hot melt adhesive can begin to set. Moreover, the speed of movement of the cartons from the carton dwell position X2 to the position X3 by the transfer mechanism is not affected by variations in the rate of fill of the carton or the duration of the dwell period between adjacent transfer cycles.

The lower lead flap folding mechanism comprises a stationary plow having a lead-on edge 151*a* that extends crosswise of the path of advance of the carton at a level offset slightly below the lower ends of the side panels, and the plow has a portion 151*b* that converges in the direction of advance of the carton to the level of the lower ends of the side panels of the cartons, and a pressure plate portion 151*c* that parallels the plane of the lower ends of the side panels to hold the closure flaps in a closed position. A lower lead flap guide 152 is provided for guiding the lower lead flap over the lead-in end 151*a* of the plow. The lower lead flap guide 152 includes a ramp portion 152*a* normally positioned in the path of advance of the lead flap of the plow and inclined downwardly and forwardly as best shown in FIG. 4 to a level below the lead-in edge 151*a*. Thus, as the carton is advanced from the carton dwell position X2 and past the lower adhesive applying nozzles 141*a* and 141*b*, the lower lead flap F4 contacts the downwardly inclined ramp portion 152*a* of the lower lead flap guide and is guided thereby below the lead-in edge 151*a* of the plow. As the carton continues movement toward the carton dwell position X3, the lead-in edge 151*a* of the plow folds the lower lead flap rearwardly in a rapid motion as shown by the heavy portion of the line designated LLF in the timing diagram in FIG. 19, infolding of the lower lead flap occurs promptly after the termination of the application of adhesive on the lower end flaps.

Provision is made for shifting the lower lead flap guide 152 laterally and outwardly of the path of advance of the carton, after it has deflected the lower lead flap below the lead-in edge of the lower lead flap plow. As best shown in FIGS. 3 and 4, the lower lead flap guide has a mounting portion 152*d* that is supported as by guide pins 152*e* and 152*f* for movement in a direction laterally of the path of travel of the cartons, and the lower lead flap guide is yieldably urged as by a spring 152*g* on one or both of the guide pins to a position disposed inwardly of the path of travel of the cartons, as shown in FIG. 3. The lower lead flap guide has a second ramp portion 152*b* at the inlet end of the ramp 152*a*, and which second ramp portion is inclined laterally relative to the path of advance of the cartons as shown in FIG. 3 to engage the panel on the carbon and move the lower lead flap guide laterally outwardly of the path as the carton is advanced.

Provision is made for infolding the lower tab T1 on the lower end of the seal flap S. The lower tab T1 is normally disposed in a plane generally paralleling the plane of the narrow side panel P1 and the lead flap folding mechanism includes a tab guide having an inlet portion 153*a* disposed in the plane of the lateral carton guide 31 at a position below the lateral carton guide and a ramp portion 153*b* that is inclined forwardly and inwardly as viewed in plan (FIG. 3) and forwardly and upwardly as viewed in side elevation (FIG. 4) to guide the lower tab T1 laterally into underlying relation with the lower flap F3, and over the lower pressure plate portion 151*c*, as the carton is advanced. As shown in FIGS. 3 and 4, the carton dwell position X3 is advantageously located above the pressure plate 151*c* so that the lower end flaps are pressed together during the dwell period of the transfer mechanism and while the hot melt adhesive at least begins to set.

Guide rods 161 extend from the pressure plate portion 151*c* of the lower lead flap folding plow forwardly along the path at the level of the lower ends of the cartons to a position below the fill nozzle, to underlie and support the carton as they are advanced and to hold the lowered flaps in a closed condition and allow additional time for the adhesive to set. As shown in FIG. 4*a*, the guide rods 161 are spaced below the nozzle a distance somewhat greater than the height of the carton and the carton elevator 73 is operated in timed relation with the transfer mechanism to elevate an empty carton after it has been advanced to a position below the nozzle. When the container at the filling station moves downwardly to a position in which the upper ends of the carton side panels are disposed adjacent the lower ends of the nozzle, the transfer cycle control switch 84 is actuated to drive the transfer mechanism through a succeeding transfer cycle, so that the pushers 44*b* on the intermediate side 44 move the filled carton crosswise of the nozzles and away from the filling station and onto carton support rails 165, while the pushers 44*a* advance a succeeding empty carton to a position below the nozzle. The carton support rails 165 extend from the filling station to the outlet end of the packaging machine at a level spaced below the lower end of the filling nozzle a distance substantially equal to the height of the side panels of the carton, to underlie and support the filled cartons.

Although the flaps on the upper end of the carton are not closed until after the filling station, it is desirable to fold the upper lead flap forwardly and the upper trail flap rearwardly before they reach the filling station. Accordingly, an upper lead flap guide member 131 (FIGS. 3 and 4) is provided for deflecting the upper lead flap forwardly and the upper trail flap rearwardly. As shown in FIG. 3, the upper lead flap guide member has an inlet end adjacent the end flap F2 on the upper end of the carton and the upper lead flap guide member extends from its inlet end along a line as viewed in plan that intersects the arc of travel A of the adjacent side edges of the upper end flaps F2 and F4 to an outlet end disposed intermediate the lateral carton guides 31 and 32. The upper lead flap guide member has an inlet portion 131*a* disposed at a level above the path of travel of the upper end flaps F2 and below the path of travel of the upper end flap F4, as the carton is moved from a magazine to a position alongside the lateral carton guide, to allow the end flap F2 to pass therebelow during movement of a panel P2 through its angle and to engage and deflect the end flap F4 laterally of the panel P4. The upper lead flap guide member also has an outlet portion 131*b* disposed outwardly of the arc A and which is inclined downwardly and in the direction of advance of the cartons to the lead of the upper ends of the side panels on the cartons, for guiding the upper lead flap F4 to a position extending forwardly from the panel P4 as the carton is advanced along the path, as best shown in FIG. 4. A finger 131*d* is provided on the lead flap guide member and extends laterally therefrom at a location to engage the trail flap F3 on the upper end of the carton, as the carton is advanced. The finger 131*d* deflects the trail flap laterally of its panel P3 and the trail flap is thereafter guided downwardly by the downwardly inclined portion 131*c* of the guide 131 to a position extending rearwardly from its panel. An upper hold down bar 135 extends along a level adjacent the top of the side panels of the cartons intermediate the lateral carton guides 31 and 32 to hold the upper lead and trail flaps in a forwardly and rearwardly extending condition respectively during advance by the inlet slide section 43.

The outlet transfer slide 45 operates to advance the filled cartons past the upper carton closing station 36 to the outlet of the packaging machine and, in its dwell or rest position, the outlet transfer slide stops the cartons at carton dwell positions designated X7, X8 and X9 in FIGS. 3*a* and 4*a*. The upper carton closing means 36 includes first and second elongated upper lateral flap guides 171 and 172 disposed above the upper ends of the side panels on the cartons in the upper flap folding zone. As shown in FIG. 3*a*, the first and second lateral flap guides have their lead-in ends 171*a* and 172*a* spaced outwardly of the lateral carton guides 31 and 32 to engage the outer sides of the end flaps F1 and F2 to guide them inwardly, and the lateral carton guides have portions 171*b* and 172*b* that converge downwardly as shown in FIG. 4*a* and terminate in portions 171*c* and 172*c* that are disposed at the level of the upper ends of the side panels. The guides 171 and 172 are thus arranged to laterally guide the side flaps F1 and F2 inwardly and downwardly into a position closing the top of the carton. In addition, they guide the lead flap F4 on the upper end of the carton to a forwardly extending condition as shown as position X8 in FIG. 4*a*. The lateral flap guides 171 and 172 are positioned relative to the outlet slide dwell position such that, at the carton dwell position X8, the trail side panel P3 of the carton is spaced below the lateral carton guides a distance at least equal to the height of the upper trail flap F3, to allow the upper trail flap to be folded forwardly. An upper trail flap lift member 175 is mounted for extension and retraction along a path crosswise of the path of movement of the cartons adjacent the upper end of the trailing side panel P3 of the carton, at the dwell position X8. The lift member is generally wedge shape as viewed in an upright plane perpendicular to the carton path and has a nose 175*a* at its forward end and a ramp portion 175*b* that is inclined upwardly and rearwardly from the nose and which is arranged to engage the trail flap F3 on the upper end of the carton at the carton dwell position X8 and lift the trail flap to a generally upright position. As shown in FIG. 3*a*, trail flap lift member is extended and retracted by a pneumatic cylinder 176 and actuation of the pneumatic cylinder is under the control of a valve (not shown) actuated by a cam in the sequence controller 130. The upper trail flap lifter 175 is normally in its retracted position shown in FIG. 3*a* and, as shown by the heavy portion of the line designated UTL in the timing diagram of FIG. 19, the upper trail flap lifter is actuated and extended to lift the trail flap shortly after the start of the transfer cycle and while the outlet transfer slide 45 is retracting, and the upper trail flap lifter is then retracted before the outlet transfer slide 45 reaches its fully retracted position.

An upper trail flap folder 178 is mounted for swinging movement on a shaft 179 in a generally upright plane adjacent the upper trail flap lift member 175. The upper trail flap folder is normally positioned in a raised position as shown in FIG. 10 during the dwell period of the machine and has an arm portion 178*a* that is arranged to engage the trail flap F3 on the upper end of the carton at carton dwell position X8 when the trail flap folder is moved to its lowered position shown in FIGS. 11 and 12. The trail flap folder 178 also has a finger portion 178*b* that is arranged to engage the lead flap F4 on the next succeeding carton at carton dwell position X7, when the trail flap folder is moved to its lowered position shown in FIG. 11. A pneumatic cylinder 181 (FIG. 3*a*) is provided for moving the upper trail flap folder between its lowered and raised positions and actuation of the cylinder is under the control of a valve (not shown) operated by a cam in the sequence controller 130. As shown by the heavy portions of the line designated UTF in the timing diagram of FIG. 19, the upper trail flap folder is moved from its normal raised position shown in FIG. 10 to its lower position shown in FIG. 11 after the upper trail flap lifter has been extended, but while the outlet slide 45 of the transfer mechanism is retracting, and the lower trail flap folder is maintained in its lower position as shown in FIG. 12 after the upper trail lifter is retracted and while the outlet transfer slide 45 advances the cartons through a portion of their forward stroke. Thus, the arm 178*a* on the upper trail flap folder holds the upper trail flap in its forwardly folded condition as the carton is advanced and until the upper trail flap underlies the portions 171*c* and 172*c* of the lateral flap guides.

Hot melt adhesive is applied to the end flaps on the upper end of the carton as the carton is advanced away from the carton dwell position designated X8 and toward the carton dwell position designated X9. Sealing of the upper end of the carton requires application of heat adhesive on the end flaps on the upper end of the carton in one strip B1 adjacent one narrow side panel of the carton, and in a second strip B2 adjacent the other side panel of the carton. As diagrammatically shown in FIGS. 3*a*, 4*a* and 8–12, valved discharge nozzles 185*a* and 185*b* are provided for applying strips of adhesive B1 and B2 on the upper end flaps on the carton, adjacent the side panels P1 and P2. The valved nozzles 185*a* and 185*b* are conveniently staggered in a direction lengthwise of the path of travel in the manner described previously in connection with the lower valved nozzles 141*a* and 141*b*, so that both valved nozzles can be turned on and off simultaneously, with one nozzle commencing application of its strip of adhesive B1 on the end flap F4 and terminating short of the end flap F3, while the other commences application at its strip B2 on the end flap F1 and ends on the end flap F3. Thus, as shown by the heavy portion of the line designated UA in the timing diagram of FIG. 19, the upper adhesive applying nozzles can be turned on and off at the same time as the lower adhesive applying nozzles so as to reduce the number of valves and cams required in the sequence controller 130 for operating the adhesive applying devices. It has been found that a single valved nozzle can be used for the upper adhesive application, if two diverging orifices are provided in the nozzle and arranged to direct diverging streams of adhesive in strips similar to strips B1 and B2.

An upper lead flap folder is provided for infolding the upper lead flap F4 into overlying relation with portions of the upper flaps F1–F3 and onto the adhesive, as the transfer mechanism advances the carton from the carton dwell position X8 to the carton dwell position designated X9 in FIG. 4*a*. The upper lead flap folding apparatus 151' is a mirror image of the lower lead flap folding apparatus 151 and like numerals followed by the postscript ' are utilized to designate corresponding parts.

Cold products such as semi-solid ice cream and the like in the carton, accelerates setting the hot melt adhesive and the upper lead flap folding mechanism 151' is also arranged to rapidly infold the upper lead flap F4 onto the previously infolded flaps F1–F3, and onto the adhesive to spread the strips of adhesive and seal the flaps in a closed condition. The upper lead flap folding mechanism is also arranged to infold the upper lead flap in response to advance of the carton therepast and the upper lead flap folding mechanism is positioned in sufficiently close proximity to the adhesive applying nozzles 185*a* and 185*b* and in relation to the carton dwell positions and stroke of the transfer mechanism so that the transfer mechanism is operative during each transfer cycle to advance a carton past the upper adhesive applying nozzles 185*a*, 185*b* and past the upper lead flap folding mechanism 151′ in a continuous forward step. The transfer mechanism is shown in its rest or dwell positions in FIGS. 3*a* and 4*a* and, in the transfer mechanism dwell position, one carton is positioned at a carton dwell position designated X8 in advance of the adhesive applying nozzles 185*a* and 185*b* and another carton is positioned at a carton dwell position designated X9, downstream of the upper lead flap folding apparatus 151′. Thus, when the transfer mechanism is operated through a cycle, it advances a carton from the carton dwell position X8 past the upper adhesive applying nozzles 185*a* and 185*b* and past the upper flap folding mechanism 151′ to the carton dwell position X9 in a single forward stroke. The cartons move very rapidly during the forward stroke of the transfer mechanism and the application of adhesive and infolding of the upper lead flap occurs in a very short time interval so that the infolded lead flap can spread the strips of adhesive before the applied adhesive starts to set. Moreover, the speed of movement of the cartons from the carton dwell position X8 to the carton dwell position X9 by the transfer mechanism is not affected by variations in the rate of fill of the carton or the duration of the dwell period between adjacent transfer cycles.

The upper lead flap folding mechanism is in the form of a stationary plow having a lead-in edge 151*a*′ that extends crosswise of the path of advance of the carton at a level offset slightly above the upper ends of the side panels, and the plow has a portion 151*b*′ that converges downwardly in the direction of advance of the carton to the level of the upper ends of the side panels of the cartons, and the pressure plate portion 151*c*′ that parallels the plane of the upper ends of the side panels to hold the upper closure flaps in a closed position. An upper lead flap guide 152′ is provided for guiding the upper lead flap over the lead-in end 151*a*′ of the plow. The upper lead flap guide 152′ includes a ramp portion 152*a*′ normally positioned in the path of advance of the lead flap of the plow and inclined upwardly and forwardly as best shown in FIG. 4*a* to a level above the lead-in edge 151*a*′. Thus, as the carton is advanced from the position X8 and past the upper adhesive applying nozzles 185*a* and 185*b*, the upper lead flap F4 contacts the upwardly inclined ramp portion 152*a*′ and is guided thereby above the lead-in edge 151*a*′ of the plow. As the carton continues movement toward the position X9, the lead-in edge 151*a*′ of the plow folds the upper lead flap rearwardly in a rapid motion. As shown by the heavy portion of the line designated ULF in the timing diagram in FIG. 19, infolding the upper lead flap occurs promptly after termination of the application of adhesive on the upper end flaps.

Provision is made for shifting the upper lead flap plow 152′ laterally outwardly of the path of advance of the carton, after it has deflected the upper lead flap above the upper lead flap folding plow. As best shown in FIGS. 3A, 4A and 13, the upper lead flap guide means has a mounting portion 152*d*′ that is supported as by guide pins 152*e*′ and 152*f*′ for movement in a direction laterally of the path of travel, and the upper lead flap guide is yieldably urged as by a spring 152*g*′ on one or both of the guide pins to a position disposed inwardly of the path of travel of the cartons, as shown in FIG. 3*a*. The upper lead flap guide has a second ramp portion 152*b*′ at the inlet end of the ramp 152*a*′, and which second ramp portion is inclined laterally relative to the path of advance of the cartons as shown in FIGS. 3*a* and 13 to engage a side panel on the carton and move the upper lead flap guide laterally outwardly of the path as the carton is advanced.

Provision is made for infolding the upper tab T1 on the upper end of the seal flap S. The upper tab T1 is normally disposed in a plane generally paralleling the plane of the narrow side panel P1 and the upper lead flap folding mechanism includes an inlet tab guide 153′ disposed adjacent the plane of the lateral carton guide 31 at a position above that lateral carton guide, and which tab guide has a ramp portion 153*a*′ that is inclined forwardly and inwardly as viewed in plan and forwardly and upwardly as viewed inside elevation (FIG. 4A) to guide the upper tab T1 laterally into overlying relation with the upper flap F3, and under the upper pressure plate portion 151*c*′, as the carton is advanced. As shown in FIGS. 3*a* and 4*a* the carton dwell position X9 is advantageously located below the pressure plate 151*c*′ so that the upper end flaps are pressed together during the dwell period of the transfer mechanism to allow the adhesive to at least start to set.

Figure 21:
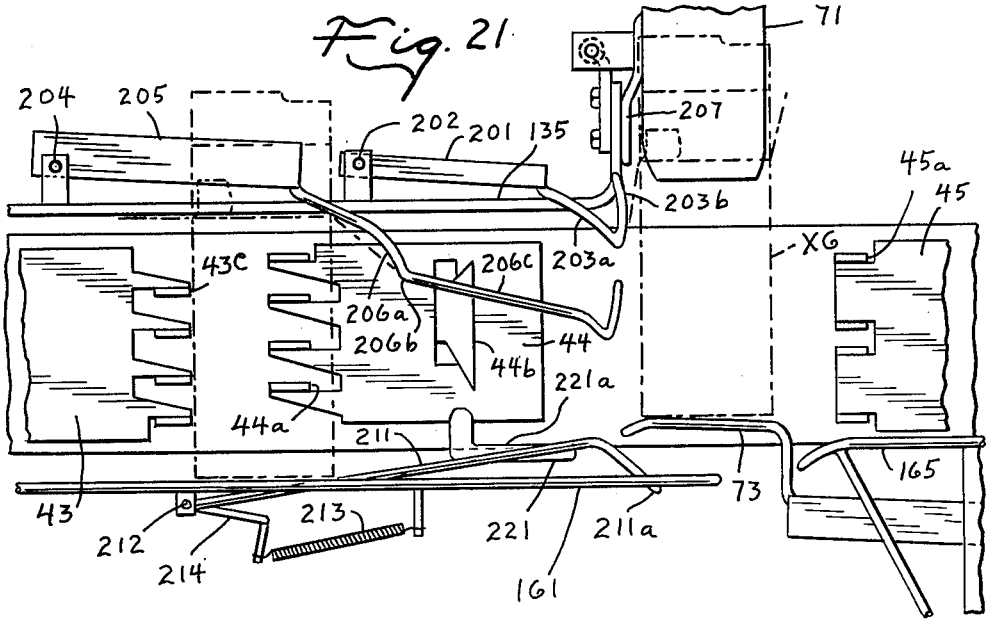
Figure 23:
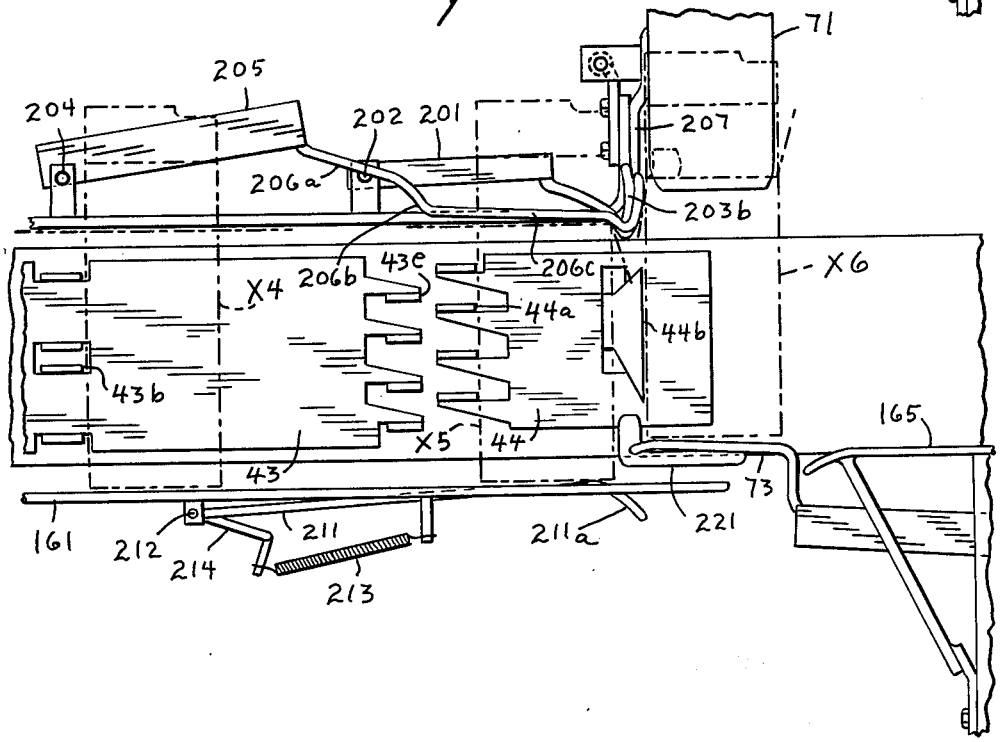

In order to prevent interference between the trail flap on the carton at the nozzle and the lead flap on the next succeeding carton, and also to prevent flaps from wiping across the product emerging from the lower end of the nozzle during movement of the cartons across the nozzle, it is necessary to deflect the trail flap on the upper end of the carton at the nozzle downwardly and to also deflect the lead flap in the next succeeding carton downwardly, and to hold the flaps in a downwardly extending position during filling and during movement of the cartons crosswise of the nozzle. A filling station flap depressor has heretofore been provided adjacent the inlet side of the nozzle. The filling station flap depressor comprises an arm 201 swingably mounted as on a pivot 202 for movement in a generally upright plane intermediate the lateral carton guides between a lower position as shown in FIGS. 20 and 21 and a raised position as shown in FIG. 23. The filling station flap depressor is gravity operated to its lower position and is supported in its lower position by engagement with the upper guide rail 135. The filling station flap depressor includes a lead flap engaging portion 203*a* which, when the arm 201 is in its lower position, extends downwardly and forwardly at a shallow acute angle of the order of 25 to 30 degrees to the horizontal, from a level above the upper end of the lead panel P4 on the carton to a level below the upper end of the lead panel on the carton, to deflect the upper lead flap F4 downwardly as the lead panel of the carton approaches the position alongside the trail panel of the carton at the fill station. The filling station flap depressor also includes a trail flap depressor portion 203*b* which extends upwardly from the forward end of the lead flap depressor portion 203*a*. The trail flap depressor portion 203*b* is spaced slightly from the inlet side of the nozzle and operates to deflect the trail flap on a carton at the filling station downwardly as that carton is elevated onto the nozzle. Guides 207 on the side of the nozzle hold the trail flap on the carton at the nozzle in a downwardly extending position as it is filled, and the trail flap depressor portion 203*b* is arranged to maintain the trail flap on the carton at the nozzle in a downwardly extending condition, as the upper end of the carton moves downwardly to the lower end of the nozzle. It was found necessary to limit the angle of the lead flap depressor portion 203*a* on the filling station flap depressor because it would drop down into the carton as soon as the lead panel on the carton moved past its lower end and it tended to hook on the trail panel and could cause deformation or tearing of the carton. In accordance with another aspect of the invention, a preliminary lead flap depressor is provided for deflecting the lead flap on the carton downwardly at a location in advance of the fill station a distance greater than the width of the carton, and the preliminary lead flap depressor so arranged that it does not contact the trail side of the carton and damage or tear the carton. The preliminary lead flap depressor can accordingly be constructed and arranged to produce a sharper bending of the lead flap. In addition, the cartons are closely adjacent each other when they are advanced by the pushers 44*a* and 44*b* on the intermediate transfer slide and, if the lead flap on the carton has a length and a width such that it would project into the path of movement of the pusher 44*b* when the lead flap is bent downwardly, it is desirable to tuck the lead flap on the carton behind the pusher 44*b*.

The preliminary lead flap depressor includes an arm 205 mounted as on a pivot 204 for swinging movement in a generally upright plane at a location substantially in advance of the filling station between a lower position as shown in FIGS. 20 and 21 and a raised position as shown in FIG. 23. The preliminary lead flap depressor is gravity urged to its lower position and the upper guide rail 125 functions as a stop to support the preliminary lead flap depressor in its lower position shown in FIGS. 20 and 21. The preliminary lead flap depressor has flap engaging portions 206*a* that are inclined downwardly and forwardly at a relatively shallow acute angle on the order of 25 to 30 degrees to the horizontal to engage and start bending of the lead flap downwardly as the carton is advanced, and the preliminary lead flap depressor has a second portion 206*b* that is inclined downwardly at a somewhat sharper angle to the horizontal, for example of the order of 70 to 80 degrees, to produce a relatively sharp bend between the lead flap and the lead panel, as the lead panel advances past the portion 206*b*. The preliminary lead flap depressor also has a portion 206*c* that extends forwardly from the portion 206*b* which is adapted to ride on the upper ends of the lead and trail panels of the carton and extends generally horizontally a distance greater than the width of the carton measured in a direction paralleling its path of advance. The portion 206*c* thus supports the preliminary lead flap depressor in a raised position on the upper end of the carton so that the portion 206*b* does not contact the trail side of the carton, as the trail side of the carton advances therepast. Advantageously, the portion 206*b* of the preliminary lead flap depressor is arranged to deflect the upper lead flap downwardly when the lead panel of the carton being advanced from carton dwell position X4 to carton dwell position X5 is at a location in advance of the fully retracted position of the pusher 44*b* on the intermediate slide, so that the lead flap will be tucked behind the pusher 44*b*. When the lead flap is tucked behind the pusher 44*b* by the preliminary lead flap depressor, the filling station flap depressor will not function to depress the upper lead flap unless the upper lead flap is too short or too narrow to remain tucked behind the pusher 44*b*.

Figure 22:
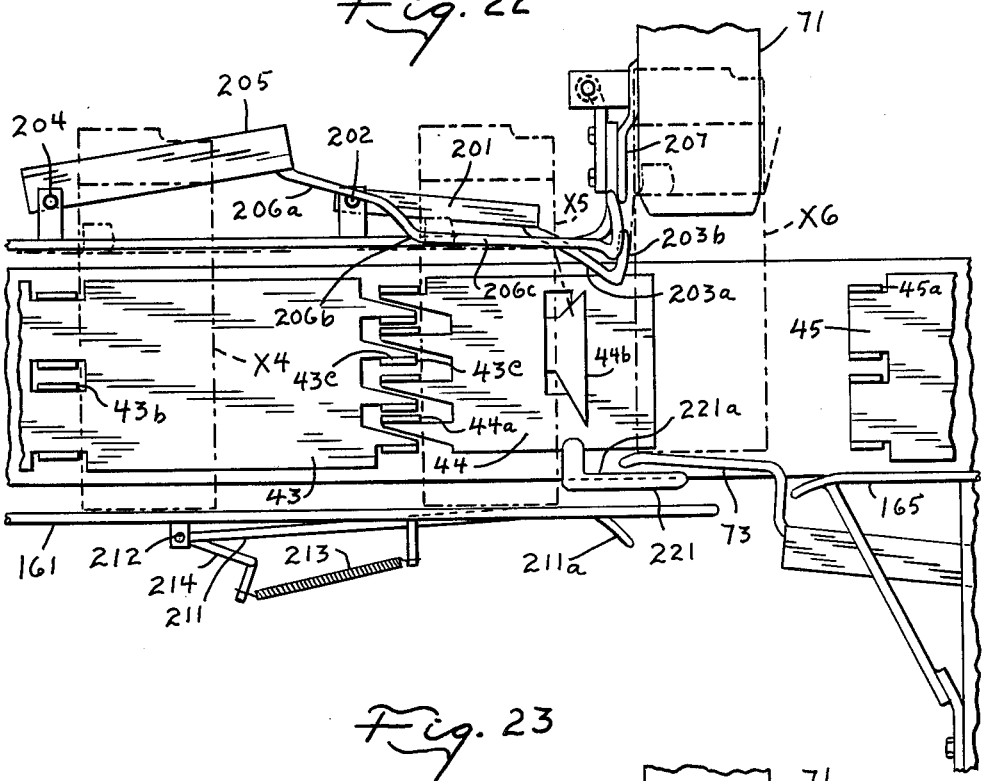

As previously described, the transfer mechanism is operated through a transfer cycle when the carton at the filling station is filled, and the pusher 44*b* on the intermediate slide operates to initially move the filled carton crosswise of the nozzle to a position at the outlet side of the nozzle and the pusher 44*a* on the intermediate slide operates to advance the succeeding carton to a position below the nozzle. The elevator then operates to elevate the empty container onto the nozzle. The intermediate transfer slide retracts as the carton is filled and the pusher 44*b* moving past the carton tends to drag the lower end of the carton rearwardly and cause the carton to tilt or cock. A carton stabilizer is provided at the filling station to prevent retrograde movement of the lower end of the carton and comprises an elongated arm 211 that is mounted as on a pivot 212 for swinging movement in an upright plane between a lower position as shown in FIG. 4*a*, 22 and 23, and a raised position as shown in FIG. 20. The arm is yieldably biased to its raised position by a spring 213 connected at one end to a crank 214 on the axis 212 and anchored at the other end to a stationary part of the frame. The crank 214 is arranged to engage the lower carton guide 165 to stop the arm when the arm is in its raised position. The arm has a nose portion 211*a* at its forward end arranged to engage the trail panel P3 of the carton at the filling station, when the arm is in its raises position, to inhibit retrograde movement of the lower end of the carton during retraction of the intermediate slide 44. The arm extends upwardly between the lateral carton guides and into the path of movement of the succeeding carton and is depressed by engagement with the lower end of the succeeding carton during advance of that carton to the carton dwell position X5 adjacent the filling station, as shown in FIGS. 21, 22 and 23.

From the foregoing it is thought the construction and operation of the intermittently cycled packaging machine will be readily understood. While one preferred embodiment of the invention is herein shown and described, persons skilled in the art to which it pertains will appreciate a number of changes and modifications which may be made without departing from the spirit of the invention. Therefore, I do not intend to be limited except by the scope of the appended claims.

The embodiments of the invention in which an exclusive property or privilege is claimed are defined as follows:

1. A packaging apparatus for erecting, filling and closing cartons having first and second opposed side panels and third and fourth opposed side panels relatively wider than the first and second side panels and articulated thereto along lengthwise edges, the cartons having first, second, third and fourth end flaps respectively articulated along at least one end of the first, second, third and fourth side panels and adapted to be infolded to close one end of the carton, the fourth end flap being substantially longer than the third end flap and dimensioned such that, when infolded last, it overlaps portions of the first, second and third end flaps, the packaging apparatus including a carton infeed zone; a lower carton closing zone; a filling station; and an upper carton closing zone arranged in the order named along a path, a carton guide means including first and second lateral carton guides for guiding cartons along said path, means including a filling nozzle at the filling station for filling cartons, carton transfer means mounted on the first and second lateral carton guides for extension and retraction along opposite sides of the path and having a plurality of carton engaging means at spaced locations therealong and operative when the transfer means is driven through a transfer cycle to advance a series of cartons forwardly along the path in a forward step, transfer drive means operative when a container at the filling station is filled for driving the transfer means through a transfer cycle, a carton magazine at the carton infeed station for storing a stack of cartons in the form of flattened tubular carton blanks, carton infeed means for feeding an end carton from the stack to the carton guide means with the lengthwise edges of the panels upright and for opening and squaring the carton blank, lower carton closing means at the lower carton closing zone for closing the lower end of the carton, an upper carton closing means at the upper carton closing zone for closing the upper end of the carton, the improvement wherein the carton infeed means is arranged to deposit cartons at the carton infeed zone so that the fourth side panel of the carton leads the third side panel during advance along said path, the carton closing means for at least said one end of the carton including first and second lateral flap folding devices for infolding the first and second end flaps on said one end of the carton, a trail flap folding mechanism for folding the third end flap on said one end of the carton forwardly into overlapping relation with portions of the first and second end flaps; a lead flap folding means for folding the fourth end flap on said one end of the carton forwardly into a generally horizontally extending condition, adhesive applying means at a preset adhesive applying location spaced along said path in the direction of advance of the cartons from the trail flap folding mechanism for applying hot melt adhesive to areas on the infolded end flaps on said one end of the carton as the cartons are advanced past the adhesive applying location, end flap guide means extending past the preset adhesive applying location for holding the third end flap on said one end of the carton in overlying relation with portions of said first and second end flaps and for guiding the fourth end flap on said one end of the carton in said generally horizontal forwardly extending condition, a lead flap folding mechanism spaced along said path in the direction of advance of the carton from said preset adhesive applying location and from said end flap guide means and being constructed and arranged to fold the fourth end flap on said one end of the carton rearwardly from said forwardly extending condition into overlying relation with portions of said first, second and third end flaps on said one end of the carton in response to advance of the carton therepast, said adhesive applying means and said lead flap folding mechanism being positioned along said path in sufficiently close proximity and at locations such that the transfer mechanism is operative during each transfer cycle to advance a carton past the adhesive applying location and past the lead flap folding mechanism in a single continuous forward step.

2. A packaging apparatus according to claim 1 wherein said lead flap folding mechanism includes a lead flap folding plow having a lead-in edge extending crosswise of said path and offset from a plane through said one end of the carton panels, lead flap guide means in advance of the lead-in edge of the lead flap folding plow and having a first ramp portion inclined relative to a plane through said one end of the carton panels for guiding the fourth end flap from said forwardly extending condition over the lead-in edge of the lead flap folding plow, said lead flap guide means being yieldably biased laterally inwardly into the path of movement of the cartons and having a second ramp portion inclined laterally relative to the path of advance of the cartons to move the lead flap guide means laterally outwardly of the path of the cartons as the carton is advanced.

3. A packaging apparatus for erecting, filling and closing cartons having first and second opposed side panels and third and fourth opposed side panels relatively wider than the first and second side panels and articulated thereto along lengthwise edges, the cartons having first, second, third and fourth end flaps articulated along the upper and lower ends of the first, second, third and fourth side panels respectively and adapted to be infolded to close the upper and lower ends of the carton, the fourth end flaps being substantially longer than the third end flaps and dimensioned such that, when infolded last, they overlap portions of the first, second and third end flaps on the respective end of the carton, the packaging apparatus including a carton infeed zone; a lower carton closing zone; a filling station; and an upper carton closing zone arranged in the order named along a path, carton guide means including first and second lateral carton guides for guiding cartons along said path, means including a filling nozzle at the filling station for filling cartons, carton transfer means mounted on the first and second lateral carton guides for extension and retraction along opposite sides of the path and having a plurality of carton engaging means at spaced locations therealong and operative when the transfer means is driven through a transfer cycle to advance a series of cartons forwardly along the path in a forward step, transfer drive means operative when a container at the filling station is filled for driving the transfer means thrugh a transfer cycle, a carton magazine at the carton infeed station for storing a stack of cartons in the form of flattened tubular carbon blanks, carton infeed means for feeding an end carton from the stack to the carton guide means with the lengthwise edges of the panels upright and for opening and squaring the carton blank, lower carton closing means at the lower carton closing zone for closing the lower end of the carton, an upper carton closing means at the upper carton closing zone for closing the upper end of the carton, the improvement wherein the carton infeed means is arranged to deposit cartons at the carton infeed zone so that the fourth side panel of the carton leads the third side panel during advance along said path, the upper and lower carton closing means each including first and second lateral flap folding devices for infolding the first and second end flaps on the respective end of the carton; a trail flap folding mechanism for folding the third end flap on the respective end of the carton forwardly into overlying relation with portions of the first and second end flaps; a lead flap folding means for folding the fourth end flap on the respective end of the carton forwardly into a generally horizontally extending condition, lower adhesive applying means at a preset lower adhesive applying location spaced along said path in the direction of advance of the cartons from the lower trail flap folding mechanism for applying hot melt adhesive to areas on the infolded end flaps on the lower end of the cartons as the cartons are advanced past the lower adhesive applying location, upper adhesive applying means at a preset upper adhesive applying location spaced along the path in the direction of advance of the cartons from the upper trail flap folding mechanism for applying adhesive to areas on the infolded end flaps on the upper end of the carton as the cartons are advanced past the upper adhesive applying location, lower end flap guide means extending past the lower adhesive applying location for holding the third end flap on the lower end of the carton in overlying relation with portions of the first and second end flaps and for guiding the fourth end flap on the lower end of the carton in said generally horizontal forwardly extending condition, a lower lead flap folding mechanism spaced along said path in the direction of advance of the carton from said preset lower adhesive applying location and from said lower end flap guide means and being constructed and arranged to fold the fourth end flap on the lower end of the carton rearwardly from said forwardly extending condition into overlying relation with portions of the first, second and third end flaps on the lower end of the carton in response to advance of the carton therepast, upper end flap guide means extending past the upper adhesive applying location for holding the third end flap on the upper end of the carton in overlying relation with portions of the first and second end flaps and for guiding the fourth end flap on the upper end of the carton in said generally horizontal forwardly extending condition, an upper lead flap folding mechanism spaced along said path in the direction of advance of the carton from said preset upper adhesive applying location and from said upper end flap guide means and being constructed and arranged to fold the fourth end flap on the upper end of the carton rearwardly from said forwardly extending condition into overlying relation with portions of the first, second and third end flaps on the upper end of the carton in response to advance of the carton therepast, each adhesive applying means and its associated lead flap folding mechanism being positioned along said path in sufficiently close proximity and at locations such that the transfer mechanism is operative during each transfer cycle to advance a carton past the lower adhesive applying location and past the lower lead flap folding mechanism in a single continuous forward step and to advance a preceding carton past the upper adhesive applying location and past the upper lead flap folding mechanism in a single continuous forward step.

4. A packaging apparatus according to claim 3 wherein the lead flap folding mechanism of the upper carton closing means includes an upper lead flap plow having a lead-in edge extending crosswise of said path and offset above a plane through the upper ends of the carton panels, upper lead flap guide means in advance of the lead-in edge of said upper lead flap plow and havng a first ramp portion inclined upwardly relative to the path of advance of cartons for guiding the fourth end flap on the upper end of the carton from said forwardly extending condition upwardly over the lead-in edge of the upper lead flap plow as the carton is advanced, said upper lead flap guide means being yieldably biased laterally inwardly into the path of movement of the panels on the cartons and having a second ramp portion inclined laterally relative to the path of advance of the cartons for engaging a panel on the carton to move the upper lead flap guide means laterally outwardly of the path of the cartons as the carton is advanced.

5. A packaging apparatus according to claim 3 wherein the flap folding mechanism of the lower carton closing means includes a lower lead flap plow having a lead-in edge extending crosswise of said path and offset slightly below a plane through the lower ends of the carton panels, lower lead flap guide means in advance of the lead-in edge of the lower lead flap plow and having a first ramp portion inclined downwardly relative to the path of advance of the cartons for guiding the fourth end flap on the lower end of the carton from said forwardly extending condition downwardly below the lead-in edge of the lower lead flap plow as the carton is advanced, the lower lead flap guide means being yieldably biased laterally inwardly into the path of movement of the panels on the cartons and having a second ramp portion inclined laterally relative to the path of advance of the cartons for engaging a panel on the carton to move the lower lead flap guide means laterally outwardly of the path of the carton as the carton is advanced.

6. A packaging apparatus according to claim 5 including lower pressure plate means extending in the direction of advance of the cartons from the lower lead flap plow at the level of the lower end of the carton panels to press the fourth end flaps on the lower end of the panels against portions of the first, second and third end flaps.

7. A packaging machine according to claim 3 including means at the carton filling station for depressing the third end flap on the upper end of the carton to a position extending downwardly from the upper end of the third side panel, said trail flap folding mechanism of the upper flap folding means including an upper trail flap lift member mounted for extension and retraction along a path crosswise of the path of movement of the cartons adjacent the upper ends of the panels of the cartons in the upper carton closing zone, the lift member having a ramp portion arranged to engage and lift the third end flap to a raised position extending upwardly from the upper end of the third side panel when the blade is extended, an upper trail flap folder mounted for swinging movement in a generally upright plane adjacent the upper trail flap lift member for engaging the third end flap on the upper end of the third panel to fold it forwardly from said raised position into overlying relation with portions of the first and second end flaps, and means operated in timed relation with the transfer means for sequentially moving the upper trail flap lift member inwardly and the upper trail flap folder downwardly.

8. A packaging apparatus according to claim 4 including means at the carton filling station for depressing the third end flap on the upper end of the carton to a position extending downwardly from the upper end of the third side panel, said first and second lateral flap folding devices of the upper carton closing means including first and second elongated upper side flap guides above the upper ends of the panels on the cartons in the upper flap folding zone having portions converging in the direction of advance of the carton relative to each other and relative to the level of the upper ends of the side panels of the cartons to infold the first and second end flaps on the ends of the first and secnd side panels in response to advance of the cartons therepast, said trail flap folding mechanism of the upper carton closing means including an upper trail flap lift member mounted for extension and retraction along a path crosswise of the path of movement of the cartons adjacent the upper ends of panels of the cartons at the upper carton closing zone, the lift member having a ramp portion arranged to engage and lift the third end flap to a raised position extending upwardly from the upper end of the third side panel when the blade is extended, an upper trail flap folder mounted for swinging movement in a generally upright plane adjacent the upper trail flap lift member for engaging the third end flap on the upper end of the third side panel to fold it forwardly from said raised position into overlying relation with portions of the second and third end flaps, means operated in timed relation with the transfer means for moving the upper trail flap lift member inwardly when the carton in the upper carton closing zone is stationary, and means operated in timed relation with the transfer means for moving the upper trail flap folder downwardly while the carton in the upper carton closing zone is stationary to forwardly fold the third end flap on the upper end of the cover member, said last mentioned means being arranged to hold the upper trail flap folder in its lower position while the transfer means advances the carton in the upper carton closing zone through a portion of its forward step.

9. A packaging apparatus according to claim 8 wherein said upper trail flap folder has means thereon engageable with the fourth flap on the next succeeding carton, when the upper trail flap folder is in its lowered position, for guiding the fourth flap on the succeeding carton to a forwardly extending condition at the underside of said first and second lateral flap guides of the upper carton closing means.

10. A packaging apparatus according to claim 3 wherein said carton guide means includes first and second lateral carton guides, the first lateral carton guide extending into the carton infeed zone, said carton magazine being constructed and arranged to support the stack of flattened carton blanks with the end carton blank in the stack disposed at an acute angle to said first lateral carton guide and spaced laterally therefrom, said cartons being stored in the magazine so that the second and fourth side panels of the end carton blank are exposed at the end of the stack with the second side panel closer to the apex of said angle than the fourth side panel, the second and fourth end flaps on each end of the carton having adjacent side edges and the fourth end flap being relatively longer than the second end flap, said carton feed means including means mounted for swinging movement through said angle and operative to move the second side panel of the end carton blank in the stack off the stack and through said angle to a position alongside the first lateral carton guide, the adjacent side edges of the second and fourth end flaps moving in an arcuate path as said second end panel is moved through said angle, means responsive to movement of the second side panel of the end carton blank off the stack and to a position alongside the first lateral carton guide for opening and substantially squaring the carton, an elongated upper lead flap guide member extending from an inlet end adjacent the second end flap on the upper end of the end carton in the magazine along a line as viewed in plan that intersects the arc of travel of said adjacent side edges of the second and fourth end flaps on the upper end of the carton to an outlet end intermediate the first and second lateral carton guides, the upper lead flap guide member having a first portion adjacent its inlet end at a level intermediate the upper ends of the second and fourth end flaps on the upper end of the carton to allow the second end flap to pass therebelow during movement of the second side panel through said angle and to engage and deflect the fourth end flap on the upper end of the carton laterally of the fourth side panel, the upper lead flap guide member having a second portion outwardly of said arcuate path inclined downwardly from said first portion toward its outlet end for guiding the fourth end flap to a position extending forwardly from the fourth panel as the carton is advanced along said path.

11. A packaging apparatus according to claim 10 including an elongated lower lead flap guide member extending from an inlet end adjacent the second end flap on the lower end of the end carton in the magazine along a line as viewed in plan that intersects the arc of travel of said adjacent side edges of the second and fourth end flaps on the lower end of the carton to an outlet end intermediate the first and second lateral carton guides, the lower lead flap guide member having a first portion adjacent its inlet end at a level intermediate the lower ends of the second and fourth end flaps on the lower end of the carton to allow the second end flap to pass thereabove during movement of the second side panel through said angle and to engage and deflect the fourth end flap on the lower end of the carton laterally of the fourth side panel.

12. A packaging apparatus according to claim 11 wherein said first and second lateral flap folding devices of the lower carton closing means includes first and second elongated lower side flap guides below the lower ends of the panels in the lower carton closing zone having portions converging in the direction of advance of the cartons relative to each other and relative to the level of the lower ends of the side panels of the carton to infold the first and second lower end flaps on the lower ends of the first and second side panels as the cartons are advanced.

13. A packaging apparatus according to claim 3 wherein said carton has a side flap articulated along a lengthwise edge of the third panel and secured to the first panel and end tabs at opposite ends of the side flap adapted to be infolded to overlap a portion of the end flap on the respective end of the third side panel, said upper and lower carton closing means each including means adjacent the respective lead flap folding means for folding the end tab on the respective end of the carton laterally into overlapping relation to a portion of the third end flap on the respective end of the third side panel.

14. A packaging apparatus according to claim 3 wherein the transfer means is mounted for extension and retraction along said path and an elevator is provided at the filling station to elevate an empty container into partial telescoping relation with the nozzle, carton stabilizing arm means mounted at a location in advance of the filling station for vertical swinging movement between a lower and a raised position, the carton stabilizing arm means when in its lower position being disposed below the path of movement of the cartons and when in its raised position extending from below the path of movement of the cartons upwardly and forwardly into the path of movement of the cartons between said lateral carton guides, the arm means having a carton engaging nose at its distal end engageable with the trailing side panel of the carton on the nozzle when the arm means is in its raised position to inhibit retrograde movement of the lower end of the carton on the nozzle during retraction of the transfer means, and means yieldably urging the arm means to its raised position with an arm lifting force that is sufficiently low to allow the arm means to be pressed downwardly to its lower position in response to engagement with the underside of a carton as it is advanced toward the filling station.

15. A packaging apparatus according to claim 3 including an upper flap depressor arm means mounted for vertical swinging movement between a lower and a raised position, said upper flap depressor arm means in its lower position having a lead flap depressor portion extending forwardly and downwardly into the path of movement of the upper end of the carton at a location spaced from the filling station a distance greater than the spacing between the leading and trailing side panels of the carton to depress the lead flap on the upper end of the carton from said forwardly extending condition as it is advanced, the upper flap depressor arm means having a guide portion extending forwardly from the lower end of said lead flap depressor portion a distance greater than the spacing between the leading and trailing side panels on the carton, said guide portion being arranged to extend generally horizontally at the level of the upper ends of the side panels of the carton when the arm means is in its raised position to support the arm means on the upper ends of the leading and trailing panels of the carton as it is advanced past the lead flap depressor portion toward the filling station and thereby prevent the lead flap depressor portion from engaging the trailing side panel of the carton.

16. A packaging apparatus for erecting, filling and closing cartons having first and second opposed side panels and third and fourth opposed side panels relatively wider than the first and second side panels and articulated thereto along lengthwise edges, the cartons having first, second, third and fourth end flaps respectively articulated along the upper end of the first, second, third and fourth side panels and adapted to be infolded to close the upper end of the carton, the packaging apparatus including a carton infeed zone; a lower carton closing zone; a filling station; and an upper carton closing zone arranged in the order named along a path, first and second spaced lateral carton guides for guiding cartons along said path, means including a filling nozzle at the filling station for filling cartons, carton transfer means mounted for extension and retraction along opposite sides of the path and having a plurality of carton engaging means at spaced locations therealong and operative when the transfer means is driven through a transfer cycle to advance a series of cartons forwardly along the path in a forward step, transfer drive means operative when a container at the filling station is filled for driving the transfer means through a transfer cycle, a carton magazine at the carton infeed station for storing a stack of cartons in the form of flattened tubular carton blanks, carton infeed means for feeding an end carton from the stack to the carton guide means with the lengthwise edges of the panels upright and for opening and squaring the carton blank, lower carton closing means at the lower carton closing zone for closing the lower end of the carton, means at the filling station for elevating a carton into at least partial telescoping relation with the nozzle, an upper carton closing means at the upper carton closing zone for closing the upper end of the carton, the improvement comprising carton stabilizing arm means mounted at a location in advance of the filling station for vertical swinging movement between a lower and a raised position, the carton stabilizing arm means when in its lower position being disposed below the path of movement of the cartons and when in its raised position extending from below the path of movement of the cartons upwardly and forwardly into the path of movement of the cartons between said lateral carton guides, the arm means having a carton engaging nose at its distal end engageable with the trailing side panel of the carton on the nozzle when the arm means is in its raised position to inhibit retrograde movement of the lower end of the carton on the nozzle during retraction of the transfer means, and means yieldably urging the arm means to its raised position with an arm lifting force that is sufficiently low to allow the arm means to be pressed downwardly to its lower position in response to engagement with the underside of a carton as it is advanced toward the filling station.

17. A packaging apparatus according to claim 16 including means for folding the fourth end flap on said upper end of the carton forwardly into a generally horizontally extending condition, an upper flap depressor arm means mounted for vertical swinging movement between a lower and a raised position, said upper flap depressor arm means in its lower position having a lead flap depressor portion extending forwardly and downwardly into the path of movement of the upper end of the carton at an upstream location spaced from the filling station a distance greater than the spacing between the leading and trailing side panels of the carton to depress the lead flap on the upper end of the carton from said forwardly extending condition as it is advanced, the upper flap depressor arm means having a guide portion extending forwardly from the lower end of said lead flap depressor portion a distance greater than the spacing between the leading and trailing side panels on the carton, said guide portion being arranged to extend generally horizontally at the level of the upper ends of the side panels of the carton when the arm means is in its raised position to support the arm means on the upper ends of the leading and trailing panels of the carton as it is advanced past the flap depressor portion toward the filling station and thereby prevent the flap depressor portion from engaging the trailing side panel of the carton.

18. A packaging apparatus for erecting, filling and closing cartons having first and second opposite side panels and third and fourth opposed side panels relatively wider than the first and second side panels and articulated thereto along lengthwise edges, the cartons having first, second, third and fourth end flaps respectively articulated along the upper end of the first, second, third and fourth side panels and adapted to be infolded to close the upper end of the carton, the packaging apparatus including a carton infeed zone; a lower carton closing zone; a filling station; and an upper carton closing zone arranged in the order named along a path, first and second spaced lateral carton guides for guiding cartons along said path, carton transfer means mounted for extension and retraction along opposite sides of the path and having a plurality of carton engaging means at spaced locations therealong and operative when the transfer means is driven through a transfer cycle to advance a series of cartons forwardly along the path in a forward step, transfer drive means operative when a container at the filling station is filled for driving the transfer means through a transfer cycle, a carton magazine at the carton infeed station for storing a stack of cartons in the form of flattened tubular carton blanks, carton infeed means for feeding an end carton from the stack to the carton guide means with the lengthwise edges of the panels upright and for opening and squaring the carton blank, lower carton closing means at the lower carton closing zone for closing the lower end of the carton, means including a filling nozzle at the filling station for filling cartons, means at the filling station for elevating a carton into at least partial telescoping relation with the nozzle, an upper carton closing means at the upper carton closing zone for closing the upper end of the carton, the improvement comprising means for folding the fourth end flap on said upper end of the carton forwardly into a generally horizontally extending condition, upper flap depressor arm means mounted for vertical swinging movement between a lower and a raised position, said upper flap depressor arm means in its lower position having a lead flap depressor portion extending forwardly and downwardly into the path of movement of the upper end of the carton at an upstream location spaced from the filling station a distance greater than the spacing between the leading and trailing side panels of the carton to depress the lead flap on the upper end of the carton from said forwardly extending condition as it is advanced, the upper flap depressor arm means having a guide portion extending forwardly from the lower end of said lead flap depressor portion a distance greater than the spacing between the leading and trailing side panels on the carton, said guide portion being arranged to extend generally horizontally at the level of the upper ends of the side panels of the carton when the arm means is in its raised position to support the arm means on the upper ends of the leading and trailing panels of the carton as it is advanced past the flap depressor portion toward the filling station and thereby prevent the flap depressor portion from engaging the trailing side panel of the carton.

19. A packaging apparatus for erecting, filling and closing cartons having first and second opposed side panels and third and fourth opposed side panels relatively wider than the first and second side panels and articulated thereto along lengthwise edges, the cartons having first, second, third and fourth end flaps articulated along the upper and lower ends of the first, second, third and fourth side panels respectively and adapted to be infolded to close the upper and lower ends of the carton, the fourth end flaps being substantially longer than the third end flaps and dimensioned such that, when infolded last, they overlap portions of the first, second and third end flaps on the respective end of the carton, the packaging apparatus including a carton infeed zone; a lower carton closing zone; a filling station; and an upper carton closing zone arranged in the order named along a path, carton guide means including first and second lateral carton guides for guiding cartons along said path, means including a filling nozzle at the filling station for filling cartons, carton transfer means mounted on the first and second lateral carton guides for extension and retraction along opposite sides of the path and having a plurality of carton engaging means at spaced locations therealong and operative when the transfer means is driven through a transfer cycle to advance a series of cartons forwardly along the path in a forward step, transfer drive means operative when a container at the filling station is filled for driving the transfer means through a transfer cycle, a carton magazine at the carton infeed station for storing a stack of cartons in the form of flattened tubular carton blanks, carton infeed means for feeding an end carton from the stack to the carton guide means with the lengthwise edges of the panels upright and for opening and squaring the carton blank, lower carton closing means at the lower carton closing zone for closing the lower end of the carton, an upper carton closing means at the upper carton closing zone for closing the upper end of the carton, the first lateral carton guide extending into the carton infeed zone, said carton magazine being constructed and arranged to support the stack of flattened carton blanks with the end carton blank in the stack disposed at an acute angle to said first lateral carton guide and spaced laterally therefrom, said cartons being stored in the magazine so that the second and fourth side panels of the end carton blank are exposed at the end of the stack with the second side panel closer to the apex of said angle than the fourth side panel, the second and fourth end flaps on each end of the carton having adjacent side edges and the fourth end flap being relatively longer than the second end flap, said carton feed means including means mounted for swinging movement through said angle and operative to move the second side panel of the end carton blank in the stack off the stack and through said angle to a position alongside the first lateral carton guide, the adjacent side edges of the second and fourth end flaps on each end of the carton moving in an arcuate path as said second end panel is moved through said angle, means responsive to movement of the second side panel of the end carton blank off the stack and to a position alongside the first lateral carton guide for opening and substantially squaring the carton, an elongated upper lead flap guide member extending from an inlet end adjacent the second end flap on the upper end of the end carton in the magazine along a line as viewed in plan that intersects the arcuate path of movement of said adjacent side edges of the second and fourth end flaps on the upper end of the carton to an outlet end intermediate the first and second lateral carton guides, the upper lead flap guide member having a first portion adjacent its inlet end at a level intermediate the upper ends of the second and fourth end flaps on the upper end of the carton to allow the second end flap to pass therebelow during movement of the second side panel through said angle and to engage and deflect the fourth end flap on the upper end of the carton laterally of the fourth side panel, the upper lead flap guide member having a second portion outwardly of said arcuate path inclined downwardly from said first portion toward its outlet end for guiding the fourth end flap to a position extending forwardly from the fourth panel as the carton is advanced along said path.

20. A packaging apparatus according to claim 19 including an elongated lower lead flap guide member extending from an inlet end adjacent the second end flap on the lower end of the end carton in the magazine along a line as viewed in plan that intersects the arcuate path of movement of said adjacent side edges of the second and fourth end flaps on the lower end of the carton to an outlet end intermediate the first and second lateral carton guides, the lower lead flap guide member having a first portion adjacent its inlet end at a level intermediate the lower ehds of the second and fourth end flaps on the lower end of the carton to allow the second end flap to pass thereabove during movement of the second side panel through said angle and to engage and deflect the fourth end flap on the lower end of the carton laterally of the fourth side panel.

* * * * *